US005275859A

United States Patent [19]

Phillips et al.

[11] Patent Number: 5,275,859

[45] Date of Patent: Jan. 4, 1994

[54] TOBACCO SMOKE FILTER

[75] Inventors: Bobby M. Phillips, Jonesborough; Steven A. Wilson, Piney Flats; Mark A. Pollock, Johnson City, all of Tenn.

[73] Assignee: Eastman Kodak Company, Rochester, N.Y.

[21] Appl. No.: 994,568

[22] Filed: Dec. 21, 1992

[51] Int. Cl.[5] ..... A24D 3/04

[52] U.S. Cl. ..... 428/65; 428/36.9; 428/74; 428/116; 428/130; 428/371; 428/438; 428/225; 428/247; 428/252; 428/332; 131/332; 131/335; 131/345; 131/343

[58] Field of Search ..... 428/36.9, 74, 116, 130, 428/371, 438, 225, 247, 252, 332; 130/332, 335, 345, 343

[56] References Cited

U.S. PATENT DOCUMENTS

| | | | |
|---|---|---|---|
| 3,144,024 | 8/1964 | Eichwald et al. | 131/208 |
| 3,236,244 | 2/1966 | Irby et al. | 131/10 |
| 3,280,823 | 10/1966 | Bavley et al. | 131/10 |
| 4,180,536 | 12/1979 | Howell et al. | 264/53 |
| 4,281,671 | 8/1981 | Bynre et al. | 131/335 |
| 4,619,279 | 10/1986 | Shiga et al. | 131/345 |
| 4,662,384 | 5/1987 | Green | 131/335 |
| 4,729,391 | 3/1988 | Woods et al. | 131/332 |
| 4,807,809 | 2/1989 | Pryor et al. | 131/84.1 |
| 4,821,750 | 4/1989 | Browne | 131/345 |
| 5,076,295 | 12/1991 | Saintsing | 131/332 |
| 5,105,834 | 4/1992 | Saintsing et al. | 131/334 |

*Primary Examiner*—Patrick J. Ryan
*Assistant Examiner*—Richard C. Weisberger
*Attorney, Agent, or Firm*—John F. Stevens; William P. Heath, Jr.

[57] ABSTRACT

Disclosed are articles, such as smoke filters, which contain fibers that have complex geometry in combination with tobacco smoke modifying agents such as flavorants. The fibers are preferably made of a polyester such as poly(ethylene terephthalate) and preferably are capable of spontaneously transporting water or n-decane on their surfaces. The articles of the invention result in improved delivery of the tobacco smoke modifying agent to the user.

16 Claims, 19 Drawing Sheets

Legend:
Spontaneously wettable polyester web filters
A - 1.3 weight percent glycerol triacetate
B - 2.8 weight percent glycerol triacetate
C - cellulose acetate control filters Legend:
Spontaneously wettable polyester web filters
A - 1.3 weight percent glycerol triacetate
B - 2.8 weight percent glycerol triacetate
C - cellulose acetate control filters

TOBACCO SMOKE FILTER

FIELD OF THE INVENTION

This invention relates to tobacco smoke filters which enhance the flavor of tobacco smoke while maintaining smoke filtering qualities.

BACKGROUND OF THE INVENTION

Many types of tobacco smoke modifying agents are known in the art to be added to smoking products to modify the tobacco smoke. For example, flavorants are added to smoking products to enhance their taste and to compensate for variations in tobacco quality and blend. Although flavorants are traditionally applied to the tobacco portion of the smoking product, this practice results in only a small fraction of the flavorant ever reaching the smoker. Most of a flavorant added to the tobacco is lost in the sidestream smoke produced during the static burn period of the smoking article or is removed by the smoke filter. The low flavorant delivery efficiencies associated with application on tobacco necessitates the use of relatively large quantities of flavorant to achieve the desired effect. Because many of these flavorants, such as menthol, for example, are expensive, inefficient utilization can add significantly to the cost of the smoking product. In addition, flavorants applied to the tobacco are subjected to the high heat of combustion which can undesirably alter their organoleptic characteristics.

In response to these problems, there has been substantial effort to apply flavorants to the filter. It was shown many years ago that smoke aerosols could transport significant quantities of relatively non-volatile materials from a structure of moderate surface area, even though a gas at a comparable temperature is ineffective in this regard. Attempts at the practical implementation of this phenomenon using cellulose acetate filters revealed, however, that although aerosols transported flavorant very efficiently from freshly made filters, this advantage was lost as the flavorant diffused away from the surface and into the bulk of the filter fibers.

Efforts to solve this problem by using polymers impermeable to the flavorants, such as polypropylene, eliminated the time dependence of flavorant delivery observed with cellulose acetate filters, but did not permit the development of a functional flavorant delivery system. The causes of this failure were, first, the flavorant delivery efficiencies for these nonpermeable polymer systems were too low to be useful, and second, impermeable filter media had no affinity for the flavorant which consequently diffused to the tobacco where it endured the same fate as flavorants applied directly to the tobacco.

In spite of years of concerted effort, neither the cigarette nor the filter material industry has developed an efficient general flavorant delivery system that does not absorb or lose the flavorant over time.

Prior art of this area reflects a strong interest in technology for the efficient and consistent delivery of tobacco smoke modifying agents, especially flavorants. However, the abundant patented technologies for flavorant delivery almost invariably employ one of the following four strategies:

1. A flavorant is contained by some physical means and is released either by mechanical destruction of the containment apparatus or by controlled leakage (see, for example, U.S. Pat. Nos. 3,219,041; 3,297,038; 3,339,557; and 4,720,423).

2. A flavorant is adsorbed on a material whose surface has been customized so that the flavorant will be displaced by the moisture or heat in the smoke (see, for example, U.S. Pat. Nos. 3,236,244; 3,280,823; and 4,662,384).

3. A flavorant is absorbed in a polymeric matrix and is then released by the plasticizing action of moisture or heat in the smoke (see, for example, U.S. Pat. Nos. 4,662,384; 3,144,024; and 4,729,391). A portion of the prior art in this area addresses the concept of modifying the fiber shape or filter geometry of current cellulose acetate filters to achieve improved flavorant containment or delivery (see, for example, U.S. Pat. Nos. 4,180,536, 4,619,279; and 4,821,750).

4. A flavorant undergoes a chemical reaction with another compound to form a new compound that will regenerate the original flavorant upon thermal decomposition (see U.S. Pat. No. 3,288,146).

Although there is substantial prior art, virtually every implementation of this art possesses limitations which render its commercial application impractical. These limitations are largely defined by the flavorant delivery strategy employed and will, therefore, be so organized here.

Mechanical or physical flavorant containment devices which are incorporated into the filter and ruptured prior to smoking are very complex and expensive to produce. They introduce significant variation into the performance of the smoking article because of inconsistencies in the pattern of their breakage, and they interfere with the normal function of the filter by altering smoke flow through the filter. They also increase the effort and complexity to the consumer who uses the product.

Adsorbed flavorants which are incorporated into the filter and released by the heat or moisture content of the smoke are not efficiently delivered until enough of the smoking article has been consumed to allow adequate moisture and heat to reach the filter. As a consequence, the flavorant is not available to augment smoke taste during the first few puffs, when it is generally acknowledged as being most needed. In addition, absorbants must be customized to achieve the desired release characteristics for each flavorant and, therefore, are not useful for delivering naturally occurring flavoring materials which consist of large numbers of independent chemical entities.

Absorbed flavorants which are dissolved in polymer matrices and released by the plasticizing action of moisture or heat in the smoke are subject to the same limitations as adsorbed flavorants. In addition, absorbed flavorants are subject to time dependent losses in delivery efficiency because of diffusion of the flavorant into the bulk of the fiber polymer. This limitation is especially evident when a conventional cellulose acetate filter is used as the flavorant absorber.

Derivatized flavorants are almost always inappropriate for use in filter flavorant delivery systems because relatively high temperatures are required for their release. Derivatized flavorants are, therefore, typically applied to the tobacco portion of the smoking product, where the liberated flavorant produced during combustion is subject to chemical alteration and loss during the static burn period of the smoking article. The development of derivatized flavorants is highly specific for each flavorant and, therefore, excludes naturally occurring flavoring materials which are composed of a large number of independent chemical entities.

Although flavorants are the most commonly used tobacco smoke modifying agents, selective removal additives can also serve as tobacco smoke modifying agents. In contrast to flavorants, selective removal additives modify tobacco smoke by removing, rather than adding, certain compounds or classes of compounds. Selective removal additives are applied to the filter and, therefore, like flavorants, can be absorbed by the filter fibers and lose their effectiveness. Here, too, significant improvements in the performance of selective removal additives could be achieved by overcoming the limitations imposed by the substrate to which the additives are applied.

We have unexpectedly discovered that if spontaneously wettable fibers described below are combined with a conventional additive, and used in a tobacco smoke filter in accordance with this invention, enhanced flavor and filtering are realized. Preferably, the spontaneously wettable fibers are formed into a nonwoven web and used as a wrap around a conventional tobacco smoke filter, i.e., as a circular layer between the conventional fibrous filter and the conventional filter wrap.

Patents of interest further include U.S. Pat. No. 4,807,809 which relates a filter rod making apparatus, and U.S. Pat. No. 5,105,834 which relates to cigarette filter containing a spray extract.

SUMMARY OF THE INVENTION

The present invention is directed to a combination comprising a web of spontaneously wettable fibers as described below, combined with at least one tobacco smoke modifying agent used with a conventional tobacco smoke filter in a particular construction.

In one embodiment, the fiber useful in the present invention is capable of spontaneously transporting water on the surface thereof and has at least one continuous groove oriented axially along the fiber, and the fiber satisfies the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

In another embodiment, the fiber useful in the present invention is capable of spontaneously transporting n-decane on the surface thereof and has at least one continuous groove oriented axially along the fiber, and said fiber satisfies the following equation $$(1-X\cos\theta_a)<0,$$

wherein $\theta_a$ is the advancing contact angle of n-decane measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

For all of the fibers useful in the present invention, it is preferred that X is greater than 1.2, more preferably greater than about 2.5, most preferably greater than about 4. Also, it is preferred that $2_D{}^r$ is greater than 1, more preferred is where $2_D{}^4$ is between 1.5 and 5.

For the fibers that spontaneously transport water, it is preferred that the fiber of the invention satisfies the formula:

$$\gamma_{LA}\cdot\frac{12\pi\cdot10^{-4}}{\sqrt{\rho}}\cdot\sqrt{dpf}\cdot(1-X\cos\theta_a)\leqq-0.3,$$

wherein $\gamma_{LA}$ is the surface tension of water in air in dynes/cm, $\rho$ is the fiber density in grams/cc, and dpf is the denier of the single fiber.

The combination of the invention preferably comprises a conventional tobacco smoke filter of fibrous tow in rod form which is wrapped with at least one layer of a web of spontaneously wettable fibers which are combined with a tobacco smoke modifying agent in the form of a tobacco smoke filter. This filter element provides improved performance in terms of better filtration versus pressure drop than found in prior art filters.

DETAILED DESCRIPTION OF THE INVENTION

Spontaneously Wettable Fibers

Figure 1:
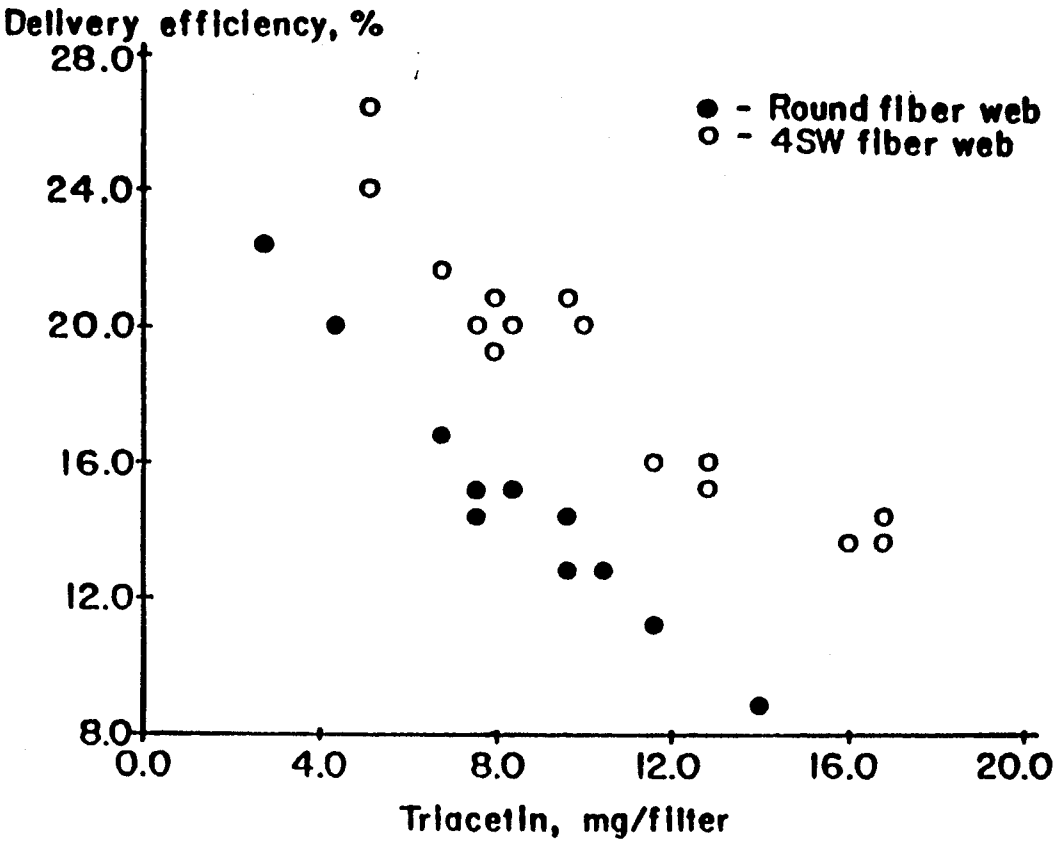
FIG. 1—graph of percent delivery efficiency versus milligrams (mg) of triacetin per filter for a cigarette filter of the invention and for a conventional cigarette filter. The ○ symbols represent filters of the invention and the ● symbols represent filters made from fibers of round cross section.

The fibers useful in the present invention have a complex cross-section geometry that results in a surface area that allows for more efficient delivery of tobacco smoke modifying agent to the user. These fibers also allow for more efficient selective removal when selective removal additives are applied to the fibers of the present invention. The fibers are preferably spontaneously transportable. For hydrophilic tobacco smoke modifying agents, the fibers are preferably the fibers that are capable of spontaneously transporting water on the surfaces thereof. Similarly, for hydrophobic tobacco smoke modifying agents, the fibers are preferably the fibers that are capable of spontaneously transporting n-decane on the surfaces thereof.

It is not desired to be bound by any particular theory or mechanism; however, it is believed that a spontaneously wettable fiber, when contacted with an appropriate fluid tobacco smoke modifying agent, transports said agent on the fiber surface thereby substantially or completely coating the fiber with the agent. Also, it is believed that if a spontaneously wettable fiber is dipped or immersed in an appropriate fluid tobacco smoke modifying agent and then removed from the fluid, said fiber retains a sufficient amount of said fluid which also results in a fiber substantially or completely coated with said agent. As used in this context, "an appropriate fluid tobacco smoke modifying agent" is one which is capable of being spontaneously transported by the fiber in question. The coated fibers are optionally allowed to dry or substantially dry prior to use.

The three important variables fundamental to the liquid transport behavior are (a) surface tension of the liquid, (b) wettability or the contact angle of the solid with the liquid, and (c) the geometry of the solid surface. Typically, the wettability of a solid surface by a liquid can be characterized by the contact angle that the liquid surface (gas-liquid interface) makes with the solid surface (gas-solid surface). Typically, a drop of liquid placed on a solid surface makes a contact angle, $\theta$, with the solid surface. If this contact angle is less than 90°, then the solid is considered to be wet by the liquid. However, if the contact angle is greater than 90°, such as with water on Teflon surface, the solid is not wet by the liquid. Thus, it is desired to have a minimum contact angle for enhanced wetting, but definitely, it must be less than 90°. However, the contact angle also depends on surface inhomogeneities (chemical and physical, such as roughness), contamination, chemical/physical treatment of the solid surface, as well as the nature of the liquid surface and its contamination. Surface free energy of the solid also influences the wetting behavior. The lower the surface energy of the solid, the more difficult it is to wet the solid by liquids having high surface tension. Thus, for example, Teflon, which has low surface energy does not wet with water. (Contact angle for Teflon-water system is 112°.) However, it is possible to treat the surface of Teflon with a monomolecular film of protein, which significantly enhances the wetting behavior. Thus, it is possible to modify the surface energy of fiber surfaces by appropriate lubricants/finishes to enhance liquid transport. The contact angle of polyethylene terephthalate (PET), nylon 66, and polypropylene with water is 80°, 71°, and 108°, respectively. Thus, nylon 66 is more wettable with water than PET. However, for polypropylene, the contact angle is >90°, and thus is nonwettable with water.

The second property of fundamental importance to the phenomena of liquid transport is surface tension of the liquid.

The third property of fundamental importance to the phenomena of liquid transport is the geometry of the solid surface. It is known that grooves enhance fluid transport in general, and that particular geometries and arrangements of deep and narrow grooves on fibers and treatments thereof can allow for the spontaneous surface transport of fluids in single fibers. Thus, preferred fibers for use herein are those with a combination of properties wherein an individual fiber is capable of spontaneously transporting water or n-decane on its surface.

The particular geometry of the deep and narrow grooves can be important. For example, in grooves which have the feature that the width of the groove at any depth is equal to or less than the width of the groove at the mouth of the groove, "bridging" of the liquid across the restriction is possible and thereby the effective wetted perimeter (Pw) is reduced. Of course, the fluid used to wet the fiber to determine the wetted perimeter is, accordingly, water in the case of fibers which spontaneously transport water, and n-decane in the case of fibers which spontaneously transport n-decane. In any case, it is preferred that Pw is substantially equal to the geometric perimeter.

The number of continuous grooves present in the fiber useful in the present invention is not critical as long as the required geometry is present. Typically there are at least 2 grooves present, and preferably less than 10.

Figure 2A:
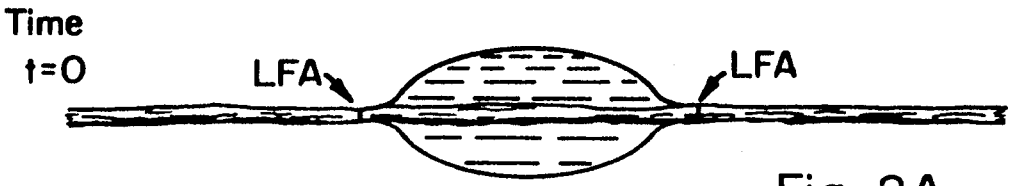
FIG. 2A—illustration of the behavior of a drop of a fluid which has just contacted a fiber that is spontaneously transportable at time=0. The arrows labelled "LFA" indicate the location of the liquid-fiber-air interface.
Figure 2B:
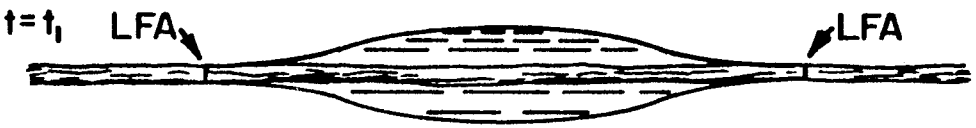
FIG. 2B—illustration of the behavior of a drop of a fluid on a fiber that is spontaneously transportable at time=$t_1$ ($t_1>0$). The arrows labelled "LFA" indicate the location of the liquid-fiber-air interface.
Figure 2C:
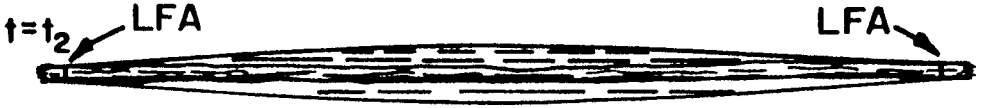
FIG. 2C—illustration of the behavior of a drop of a fluid on a fiber that is spontaneously transportable at time=$t_2$ ($t_2>t_1$). The arrows labelled "LFA" indicate the location of the liquid-fiber-air interface.

"Spontaneously transportable" (or spontaneously wettable) and derivative terms thereof refer to the behavior of a fluid in general and in particular a drop of fluid, such as water or n-decane, when it is brought into contact with a single fiber such that the drop spreads along the fiber. Such behavior is contrasted with the normal behavior of the drop which forms a static ellipsoidal shape with a unique contact angle at the intersection of the liquid and the solid fiber. It is obvious that the formation of the ellipsoidal drop takes a very short time but remains stationary thereafter. FIGS. 2A, 2B and 2C illustrate spontaneous fluid transport on a fiber surface. The key factor is the movement of the location of the air, liquid, solid interface with time. If such interface moves just after contact of the liquid with the fiber, then the fiber is spontaneously transportable; if such interface is stationary, the fiber is not spontaneously transportable. The spontaneously transportable phenomenon is easily visible to the naked eye for large filaments (>20 denier per filament (dpf)) but a microscope may be necessary to view the fibers if they are less than 20 dpf. Colored fluids are more easily seen but the spontaneously transportable phenomenon is not dependent on the color. It is possible to have sections of the circumference of the fiber on which the fluid moves faster than other sections. In such case the air, liquid, solid interface actually extends over a length of the fiber. Thus, such fibers are also spontaneously transportable in that the air, liquid, solid interface is moving as opposed to stationary.

Spontaneous transportability is basically a surface phenomenon; that is the movement of the fluid occurs on the surface of the fiber. However, it is possible and may in some cases be desirable to have the spontaneously transportable phenomenon occur in conjunction with absorption of the fluid into the fiber. The behavior visible to the naked eye will depend on the relative rate of absorption vs. spontaneous transportability. For example, if the relative rate of absorption is large such that most of the fluid is absorbed into the fiber, the liquid drop will disappear with very little movement of the air, liquid, solid interface along the fiber surface whereas if the rate of absorption is small compared to the rate of spontaneous transportability the observed behavior will be that of wicking or transport, as exemplified in FIGS. 2A through 2C. In FIG. 2A, a drop of aqueous fluid is just placed on the fiber (time=0). In FIG. 2B, a time interval has elapsed (time=$t_1$) and the fluid starts to be spontaneously transported. In FIG. 2C, a second time interval has passed (time=$t_2$) and the fluid has been spontaneously transported along the fiber surface further than at time=$t_1$.

A preferred fiber useful in the present invention is capable of spontaneously transporting water on the surface thereof. Distilled water can be employed to test the spontaneous transportability phenomenon; however, it is often desirable to incorporate a minor amount of a colorant into the water to better visualize the spontaneous transport of the water, so long as the water with colorant behaves substantially the same as pure water under test conditions. We have found aqueous Syltint Poly Red (trademark) from Milliken Chemicals to be a useful solution to test the spontaneous transportability phenomenon. The Syltint Poly Red solution can be used undiluted or diluted significantly, e.g., up to about 50x with water. In addition to being capable of transporting water, such a fiber useful in the present invention is also capable of spontaneously transporting a multitude of other hydrophilic fluids such as aqueous fluids. Aqueous fluids are those fluids comprising about 50% or more water by weight, preferred is about 75% or more water by weight, most preferred is about 90% or more water by weight. In addition to being able to transport aqueous fluids, such a fiber useful in the present invention is also capable of transporting an alcoholic fluid on its surface. Alcoholic fluids are those fluids comprising greater than about 50% by weight of an alcoholic compound of the formula $$R—OH$$

wherein R is an aliphatic or aromatic group containing up to 12 carbon atoms. It is preferred that R is an alkyl group of 1 to 6 carbon atoms, more preferred is 1 to 4 carbon atoms. Examples of alcohols include methanol, ethanol, n-propanol and isopropanol. Preferred alcoholic fluids comprise about 70% or more by weight of a suitable alcohol. Of course, it is also preferred that such a fiber is capable of spontaneously transporting hydrophilic tobacco smoke modifying agents.

Another class of preferred fibers useful in the present invention is capable of spontaneously transporting n-decane on the surface thereof. As in the case of water as described hereinbefore, the n-decane can be colorized for better visualization. In addition to being capable of spontaneously transporting n-decane, such a fiber is also typically capable of spontaneously transporting other hydrophobic fluids such as cyclohexane, xylene or α-pinene. Of course, it is also preferred that such a fiber is capable of spontaneously transporting hydrophobic tobacco smoke modifying agents.

The fibers useful in the invention can be comprised of any material known in the art capable of having a cross-section of the desired geometry. Preferred materials for use in the present invention are polyesters.

The preferred polyester materials useful in the present invention are polyesters or copolyesters that are well known in the art and can be prepared using standard techniques, such as, by polymerizing dicarboxylic acids or esters thereof and glycols. The dicarboxylic acid compounds used in the production of polyesters and copolyesters are well known to those skilled in the art and illustratively include terephthalic acid, isophthalic acid, p,p'-diphenyldicarboxylic acid, p,p'-dicarboxydiphenyl ethane, p,p'-dicarboxydiphenyl hexane, p,p'-dicarboxydiphenyl ether, p,p'-dicarboxyphenoxy ethane, and the like, and the dialkylesters thereof that contain from 1 to about 5 carbon atoms in the alkyl groups thereof.

Suitable aliphatic glycols for the production of polyesters and copolyesters are the acyclic and alicyclic aliphatic glycols having from 2 to 10 carbon atoms, especially those represented by the general formula $HO(CH_2)_pOH$, wherein p is an integer having a value of from 2 to about 10, such as ethylene glycol, trimethylene glycol, tetramethylene glycol, and pentamethylene glycol, decamethylene glycol, and the like.

Other known suitable aliphatic glycols include 1,4-cyclohexanedimethanol, 3-ethyl-1,5-pentanediol, 1,4-xylylene, glycol, 2,2,4,4-tetramethyl-1,3-cyclobutanediol, and the like. One can also have present a hydroxylcarboxyl compound such as 4,-hydroxybenzoic acid, 4-hydroxyethoxybenzoic acid, or any of the other hydroxylcarboxyl compounds known as useful to those skilled in the art.

It is also known that mixtures of the above dicarboxylic acid compounds or mixtures of the aliphatic glycols can be used and that a minor amount of the dicarboxylic acid component, generally up to about 10 mole percent, can be replaced by other acids or modifiers such as adipic acid, sebacic acid, or the esters thereof, or with modifiers that impart improved dyeability to the polymers.

The most preferred polyester for use in preparing the fiber useful in the invention is poly(ethylene terephthalate) (PET).

Other materials that can be used to make the base fibers include polyamides such as a nylon, e.g., nylon 66 or nylon 6; polypropylene; polyethylene; and cellulose esters such as cellulose triacetate or cellulose diacetate.

A single fiber useful in the present invention preferably has a denier of between about 1 and about 1,000, more preferred is between about 5 and about 70.

The fibers useful in the invention preferably have a surface treatment applied thereto. Such surface treatment may or may not be critical to obtain the desired spontaneous transportability property. The nature and criticality of such surface treatment for any given fiber can be determined by a skilled artisan through routine experimentation using techniques known in the art and/or disclosed herein. A preferred surface treatment, when a hydrophilic tobacco smoke modifying agent is contemplated, is a coating of a hydrophilic lubricant on the surface of the fiber. A preferred surface treatment, when a hydrophobic tobacco smoke modifying agent is contemplated, is a coating of a hydrophobic lubricant on the surface of the fiber. Such coatings are typically uniformly applied at about a level of at least 0.05 weight percent, with about 0.1 to about 2 weight percent being preferred, based on the weight of the fiber. Preferred hydrophilic lubricants include a potassium lauryl phosphate based lubricant comprising about 70 weight percent poly(ethylene glycol) 600 monolaurate. A preferred hydrophobic lubricant is mineral oil. Another surface treatment is to subject the fibers to oxygen plasma treatment, as taught in, for example, *Plastics Finishing and Decoration,* Chapter 4, Ed. Don Satas, Van Nostrand Reinhold Company (1986).

FIGS. 3 through 8 illustrate spinneret orifices which will prepare fibers of a geometry suitable for use in the present invention.

Figure 3:
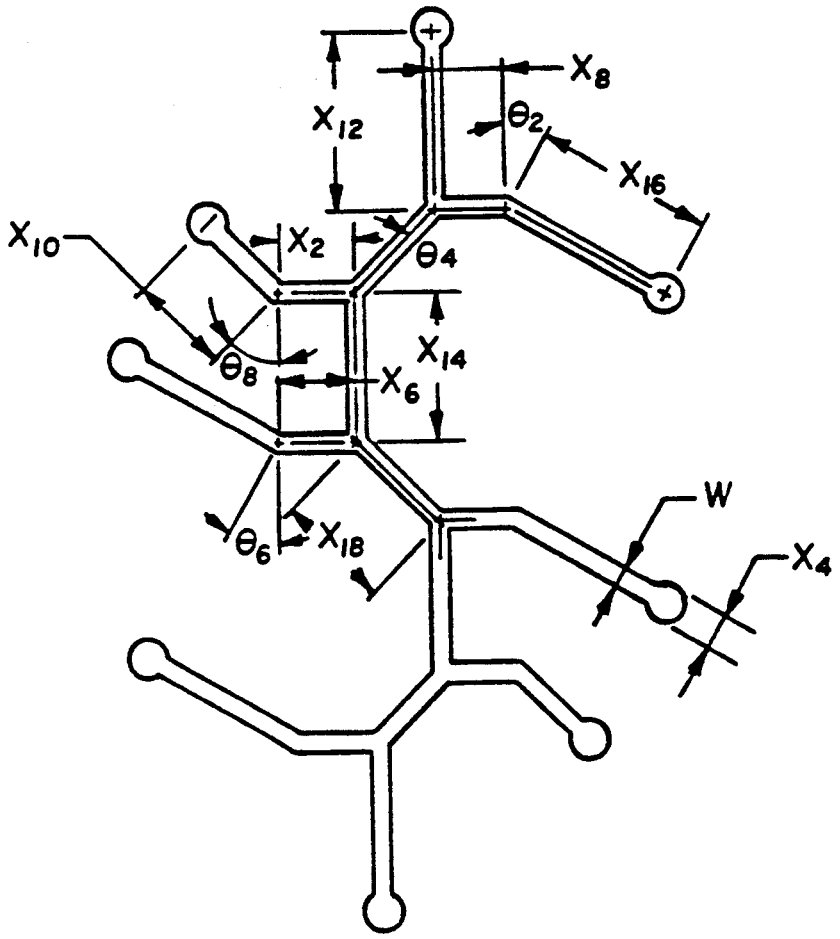
FIG. 3—schematic representation of an orifice of a spinneret useful for producing a spontaneously transportable fiber.

In FIG. 3, $W$ is between 0.064 millimeters (mm) and 0.12 mm. $X_2$ is $4W^{+4W}_{-1W}$; $X_4$ is $2W \pm 0.5W$; $X_6$ is $6W^{+4W}_{-2W}$; $X_8$ is $6W^{+5W}_{-2W}$; $X_{10}$ is $7W^{+5W}_{-2W}$; $X_{12}$ is $9W^{+5W}_{-1W}$; $X_{14}$ is $10W^{+5W}_{-2W}$; $X_{16}$ is $11W^{+5W}_{-2W}$; $X_{18}$ is $6W^{+5W}_{-2W}$; $\theta_2$ is $30° \pm 30°$; $\theta_4$ is $45° \pm 45°$; $\theta_6$ is $30° \pm 30$; and $\theta_8$ is $45° \pm 45°$.

Figure 4:
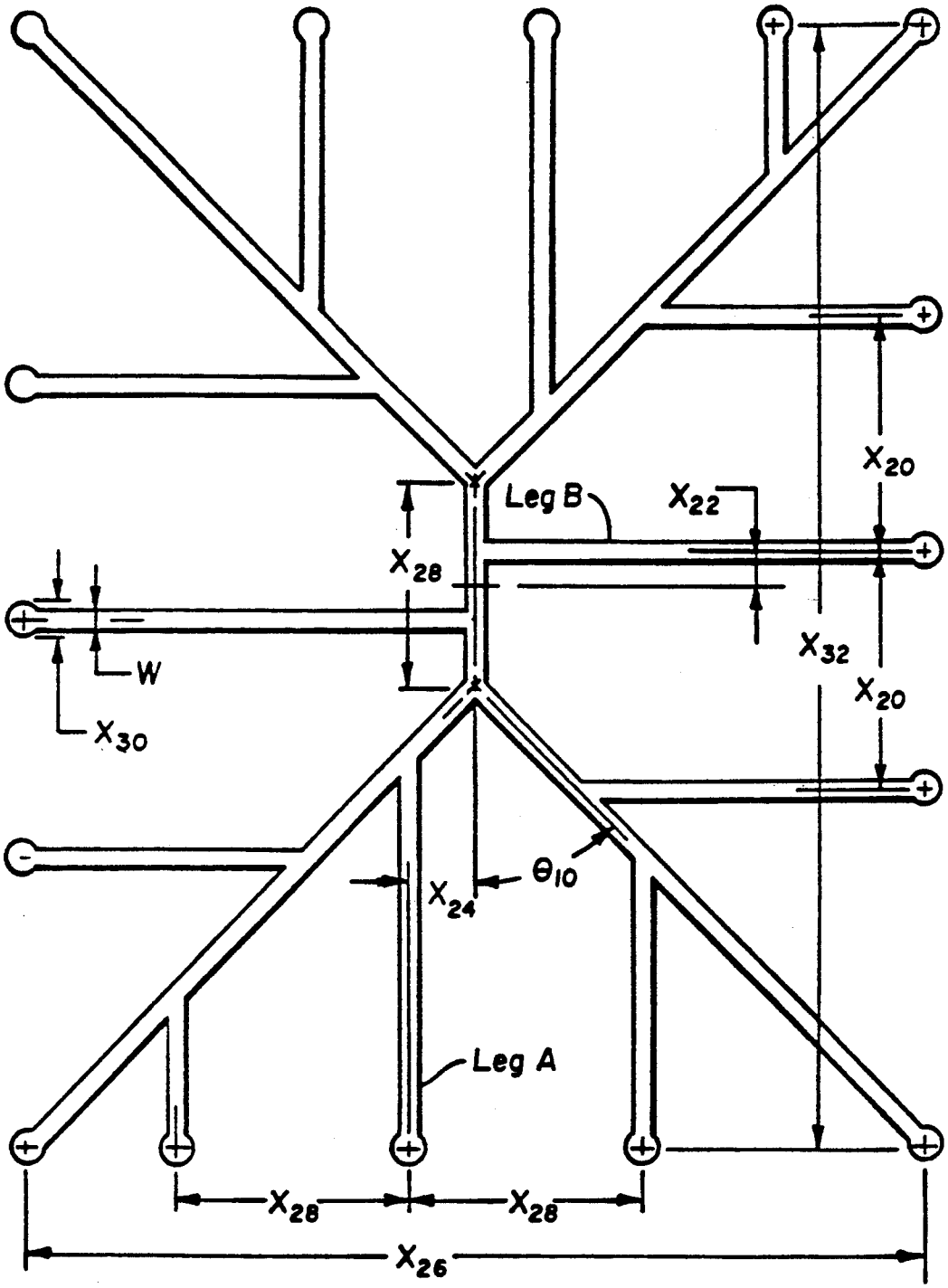
FIG. 4—schematic representation of an orifice of a spinneret useful for producing a spontaneously transportable fiber.

In FIG. 4, $W$ is between 0.064 mm and 0.12 mm; $X_{20}$ is $17W^{+5W}_{-2W}$; $X_{22}$ is $3W \pm W$; $X_{24}$ is $4W \pm 2W$; $X_{26}$ is $60W^{+8W}_{-4W}$; $X_{28}$ is $17W^{+5W}_{-2W}$; $X_{30}$ is $2W \pm 0.5W$; $X_{32}$ is $72W^{+10W}_{-5W}$; and $\theta_{10}$ is $45° \pm 15°$. In addition, each Leg $B$ can vary in length from 0 to $\frac{X_{26}}{2}$; and each Leg $A$ can vary in length from 0 to $$\text{ten}(90 - \theta_{10})\left[\frac{X_{26}}{2} - X_{24}\right].$$

Figure 5:
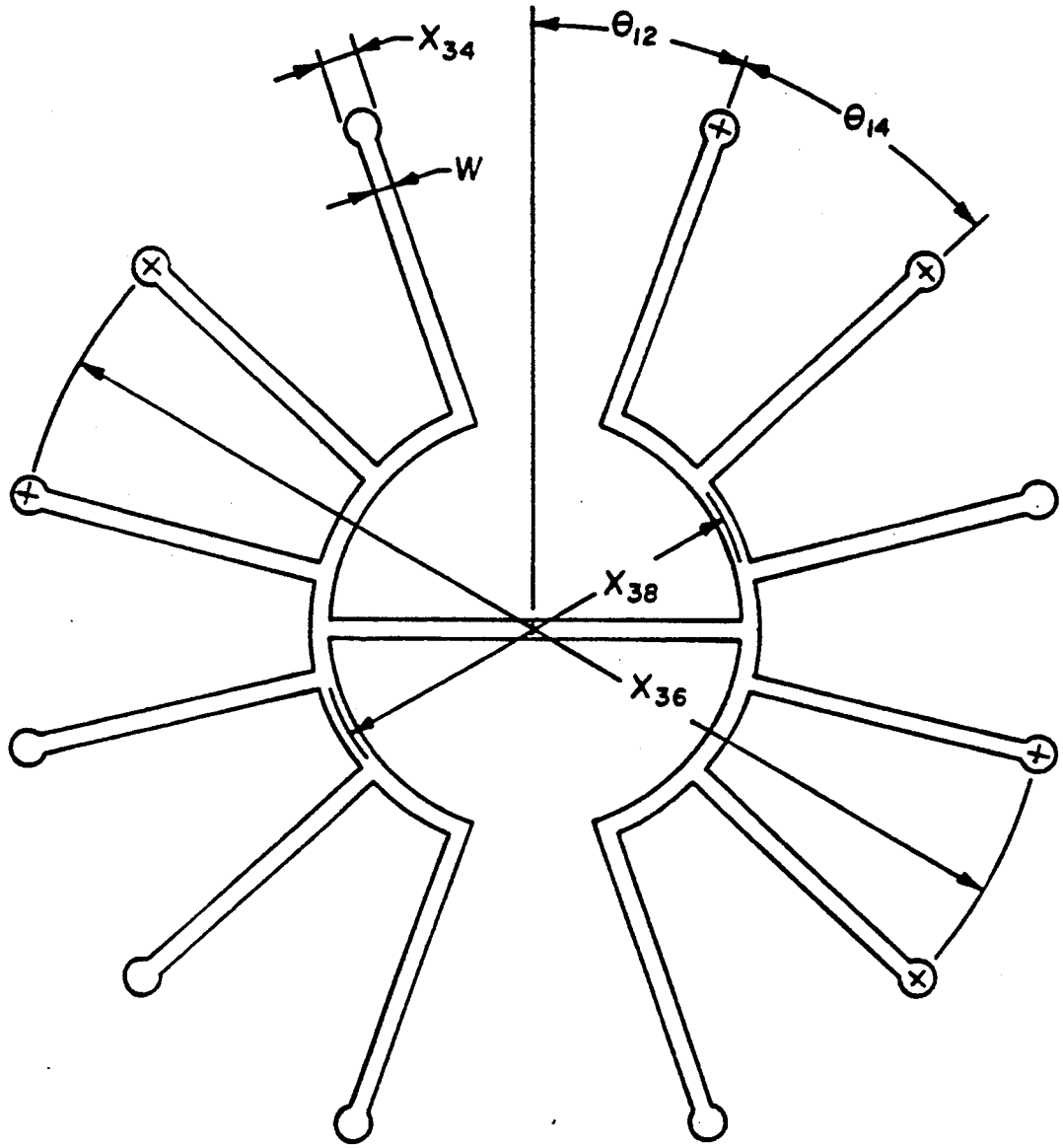
FIG. 5—schematic representation of an orifice of a spinneret useful for producing a spontaneously transportable fiber.

In FIG. 5, $W$ is between 0.064 mm and 0.12 mm; $X_{34}$ is $2W \pm 0.5W$; $X_{36}$ is $58W^{+20W}_{-10W}$; $X_{38}$ is $24W^{+20W}_{-5W}$; $\theta_{12}$ is $20°^{+15°}_{-10°}$; $\theta_{14}$ is $\frac{1° - 2\theta_{12}}{n - 1}$; and $n$ = number of legs per 180° = 2 to 6.

Figure 6:
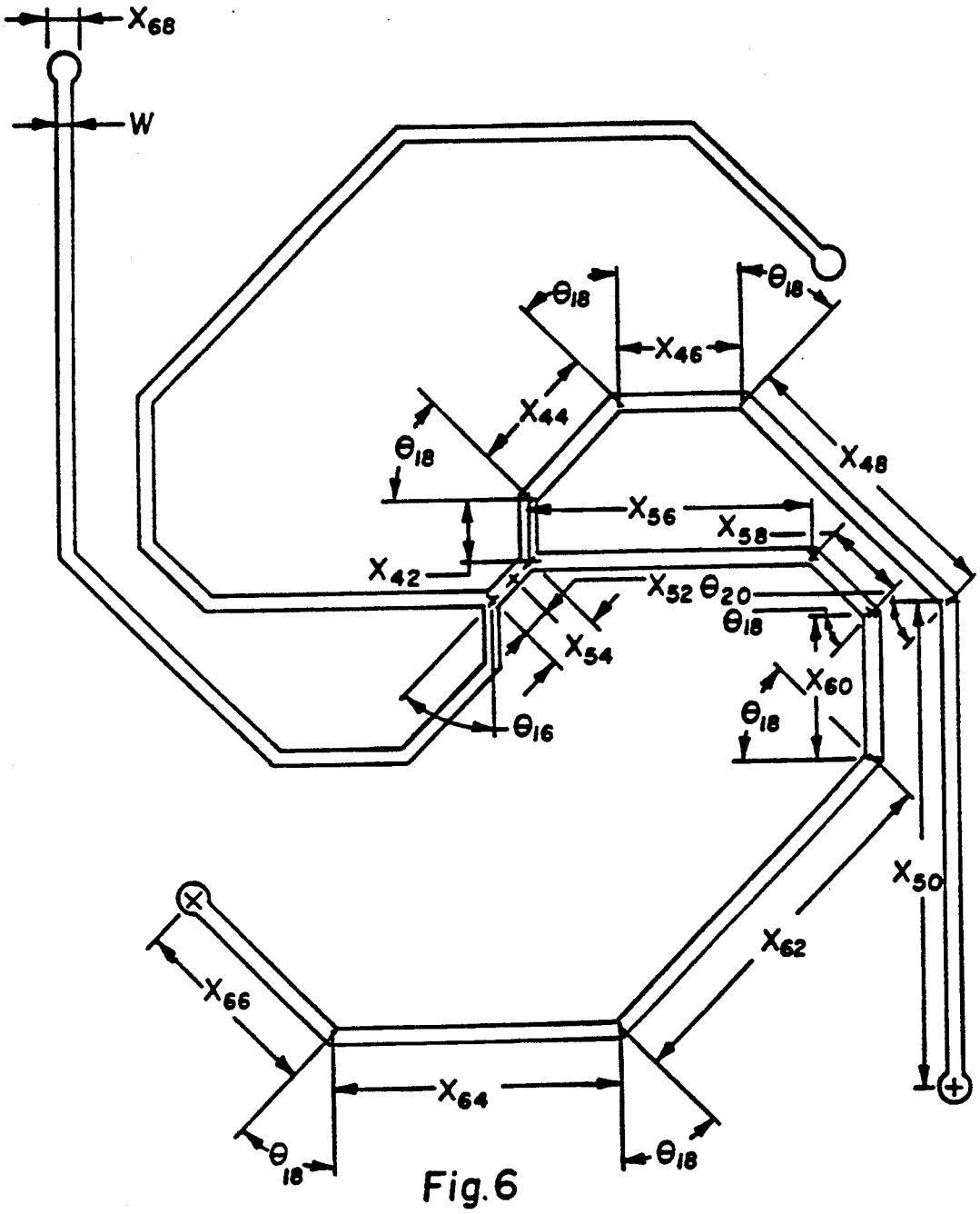
FIG. 6—schematic representation of an orifice of a spinneret useful for producing a spontaneously transportable fiber.

In FIG. 6, $W$ is between 0.064 mm and 0.12 mm; $X_{42}$ is $6W^{+4W}_{-2W}$; $X_{44}$ is $11W \pm 5W$; $X_{46}$ is $11W \pm 5W$; $X_{48}$ -continued is $24W \pm 10W$; $X_{50}$ is $38W \pm 13W$; $X_{52}$ is $3W^{+3W}_{-1W}$; $X_{54}$ is $6W^{+6W}_{-2W}$; $X_{56}$ is $11W \pm 5W$; $X_{58}$ is $7W \pm 5W$; $X_{60}$ is $17W \pm 7W$; $X_{62}$ is $28W \pm 11W$; $X_{64}$ is $24W \pm 10W$; $X_{66}$ is $17W \pm 7W$; $X_{68}$ is $2W \pm 0.5W$; $\theta_{16}$ is $45^{\circ}{}^{+30^{\circ}}_{-15^{\circ}}$; $\theta_{18}$ is $45^{\circ} \pm 15^{\circ}$; and $\theta_{20}$ is $45^{\circ} \pm 15^{\circ}$.

Figure 6B:
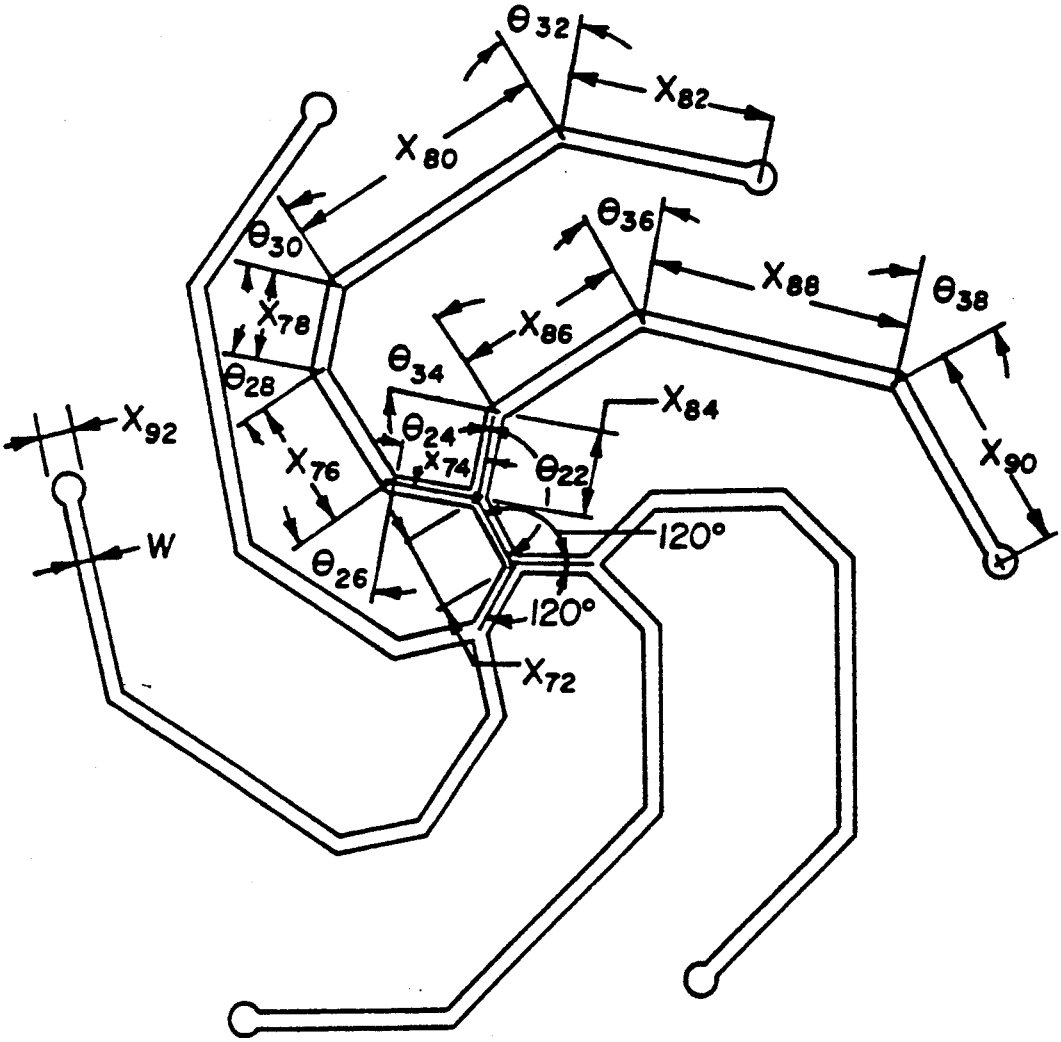
FIG. 6B—schematic representation of an orifice of a spinneret useful for producing a spontaneously transportable fiber.

In FIG. 6B $W$ is between 0.064 mm and 0.12 mm, $X_{72}$ is $8W^{+4W}_{-2W}$, $X_{74}$ is $8W^{+4W}_{-2W}$, $X_{76}$ is $12W \pm 4W$, $X_{78}$ is $8W \pm 4W$, $X_{80}$ is $24W \pm 12W$, $X_{82}$ is $18W \pm 6W$, $X_{84}$ is $8W^{+4W}_{-2W}$, $X_{86}$ is $16W \pm 6W$, $X_{88}$ is $24W \pm 12W$, $X_{90}$ is $18W \pm 6W$, $X_{92}$ is $2W \pm 0.5W$, $\theta_{22}$ is $135^{\circ} \pm 30^{\circ}$, $\theta_{24}$ is $90^{\circ} \pm {}^{45^{\circ}}_{30^{\circ}}$, $\theta_{26}$ is $45^{\circ} \pm 15^{\circ}$, $\theta_{28}$ is $45^{\circ} \pm 15^{\circ}$, $\theta_{30}$ is $45^{\circ} \pm 15^{\circ}$, $\theta_{32}$ is $45^{\circ} \pm 15^{\circ}$, $\theta_{34}$ is $45^{\circ} \pm 15^{\circ}$, $\theta_{36}$ is $45^{\circ} \pm 15^{\circ}$, and $\theta_{38}$ is $45^{\circ} \pm 15^{\circ}$.

Figure 7:
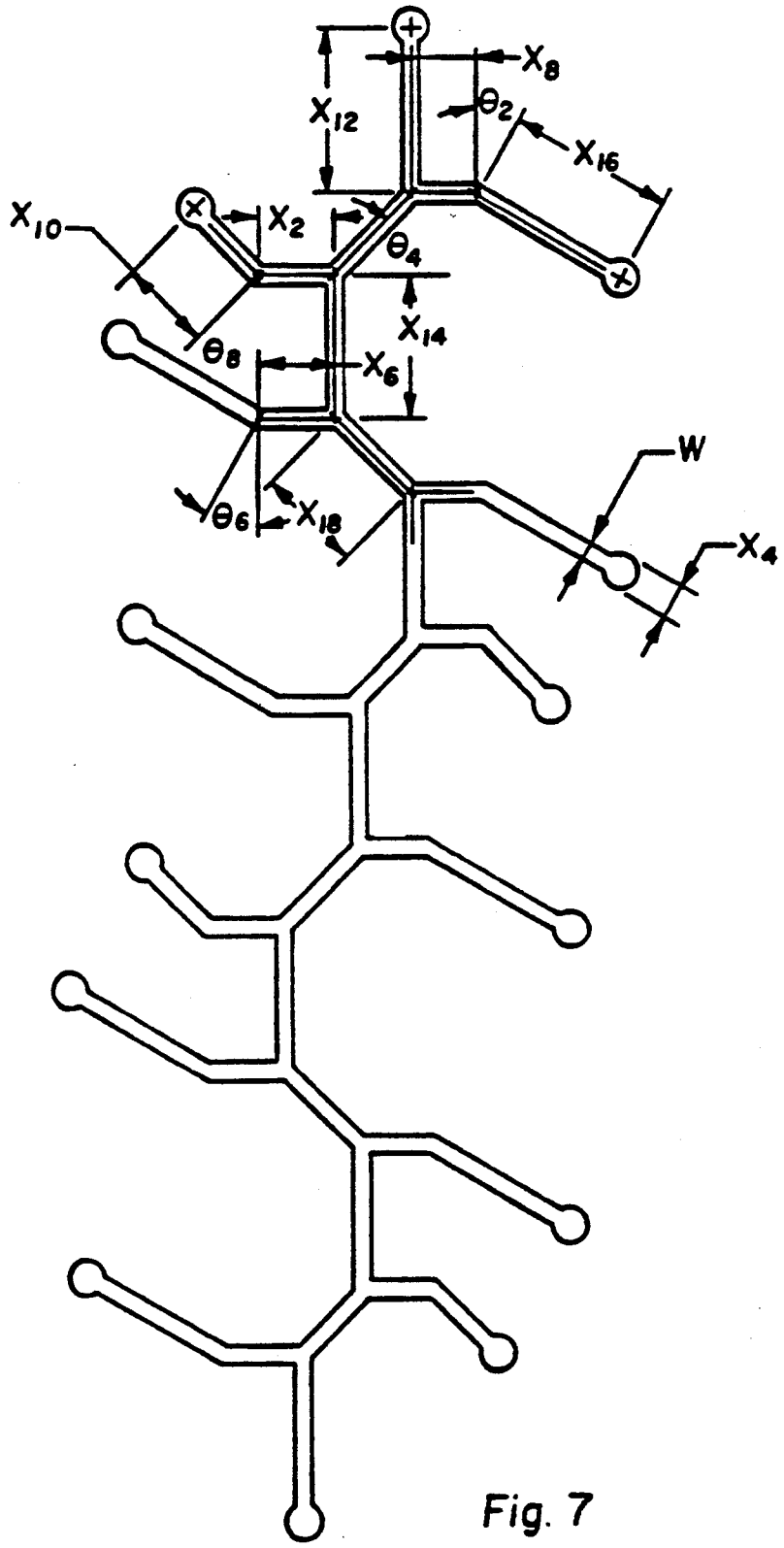
FIG. 7—schematic representation of an orifice of a spinneret having 2 repeating units, joined end to end, of the orifice as shown in FIG. 3.

In FIG. 7, the depicted spinneret orifice contains two repeat units of the spinneret orifice depicted in FIG. 3, therefore, the same dimensions for FIG. 3 apply to FIG. 7. Likewise, in FIG. 8, the depicted spinneret orifice contains four repeat units of the spinneret orifice depicted in FIG. 3, therefore, the same dimension for FIG. 3 applies to FIG. 8.

Figure 16:
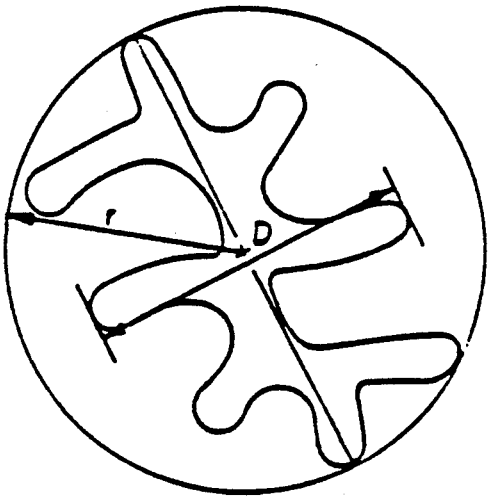
FIG. 16—schematic representation of a fiber cross-section made using a spinneret having an orifice as illustrated in FIG. 3 (Example 1). Exemplified is a typical means of determining the shape factor X.

FIG. 16 illustrates the method for determining the shape factor, X, of the fiber cross-section. In FIG. 16, r=37.5 mm, $P_w$=355.1 mm, D=49.6 mm; thus, for the fiber cross section of FIG. 16:

$$X = \frac{355.1}{4 \times 37.5 + (\pi - 2)\,49.6} = 1.72.$$

Tobacco Smoke Modifying Agent

The tobacco smoke modifying agent useful in the present invention can be any such agent used in tobacco products and/or tobacco substitute products where delivery of such agent to the user is desirable. Such agents typically modify the taste and/or aroma of smoking products. Thus, the tobacco smoke modifying agent can be a flavorant or other aromatic material including both naturally occurring and synthetic materials regardless of their hydrophobic or hydrophilic nature. Examples of such tobacco smoke modifying agents include flavorants, synergistic flavor enhancers, physiological coolants and other mouth or throat stimulants, with flavorants being preferred.

Examples of flavorants include tobacco flavorants comprising naturally occurring materials such as aqueous (hydrophilic) tobacco extracts (as disclosed in U.S. Pat. No. 3,316,919 incorporated herein by reference in its entirety) and aromatics (as disclosed in U.S. Pat. No. 3,424,171 incorporated herein by reference in its entirety), and synthetic materials which augment the minty, camphoraceous, spicy, peppery, fruity, flowery, woody, green, or other tobacco flavor and aroma notes. Other flavorants contemplated for use in the invention include naturally occurring or synthetic flavorants which introduce flavors that are not normally indigenous to tobacco such as the following which have been demonstrated to be useful on filters by U.S. Pat. No. 3,144,024 (incorporated herein by reference in its entirety), wine, rum, coumarin, honey, vanilla, juniper, molasses, maple syrup, chocolate, menthol, and sugars. In addition, vanillin, licorice, anethole, anise, cocoa, cocoa and chocolate by products, sugars, humectants, eugenol, clove oil, triacetin, and other generally accepted cellulose acetate flavorant filter additives.

Examples of synergistic flavor enhancers include smoothers such as glutamates and nucleotides as disclosed in U.S. Pat. No. 3,397,700 (incorporated herein by reference in its entirety) and 2 cyclohexylcyclohexanone as disclosed in U.S. Pat. No. 3,342,186 (incorporated herein by reference in its entirety).

Examples of naturally occurring physiological coolants include mint oils, menthol, camphor and camphoraceous compounds.

Examples of synthetic physiological coolants include synthetic menthol and menthol derivatives (the latter exemplified by menthol monoester disclosed in U.S. Pat. No. 3,111,127 (incorporated herein by reference in its entirety), menthol acetals disclosed in U.S. Pat. No. 3,126,012 (incorporated herein by reference in its entirety), menthol ethers disclosed in U.S. Pat. No. 3,128,772 (incorporated herein by reference in its entirety), menthol esters disclosed in U.S. Pat. No. 3,136,319 (incorporated herein by reference in its entirety), synthetic camphor and camphoraceous compounds such as cyclohexenones and cyclohexanones disclosed in U.S. Pat. No. 3,380,456 (incorporated herein by reference in its entirety), and synthetic coolants as disclosed in U.K. Patents 1,351,761 and 1,351,762 and U.S. Pat. Nos. 4,296,255 and 4,230,688.

Examples of other mouth or throat stimulating compounds include either natural or synthetic compounds such as nicotine, and its derivatives, including, for example, nicotine complexes and salts disclosed in U.S. Pat. No. 3,109,436 (incorporated herein by reference in its entirety).

A feature of the invention is the spontaneously wettable character of the fibers. Although not desired to be bound by any particular theory or mechanism, it is believed that the ability of spontaneously wettable fibers to transport and spread fluids on fibers having high surface areas which are not necessarily penetrated by the modifying agent is responsible for the high delivery efficiencies and high percentage of selective removal of unwanted substrates achieved by the combination of the invention. The invention is, therefore, not limited to a specific polymer or fiber treatment, such as fiber finish, or to a particular form of final fiber assemblage. The invention is not limited in its uses to cigarettes and is likewise applicable to all smoking products including pipes, and even novel and as yet unconceived of aerosol sources. Thus, the combination of the present invention is preferably in the form of a tobacco smoke filter or material useful for the preparation thereof. Cigarette filters are especially preferred.

The combination of the invention is useful for the efficient and uniform delivery of tobacco smoke modifying agents. The combination of the invention is also useful for efficient and uniform selective removal of unwanted substances such as phenol or nicotine. The direct economic value of the invention results from cost savings achieved through reductions in the quantity of expensive agents, especially flavorants and selective removal additives, that are needed to achieve a desired organoleptic effect. Other benefits of the invention include increased shelf life, improved consistency of product taste which results from more constant delivery of the tobacco smoke modifying agent over time, and improved efficiency of selective removal of unwanted substances.

To prepare the combination of the invention, the tobacco smoke modifying agent(s) and/or selective removal additive of choice is applied, typically as a fluid, to fibers or an assemblage of, spontaneously wettable fibers. Such assemblage can be, for example, a nonwoven web. The spontaneously wettable fibers are preferably made into a nonwoven web by conventional techniques well known in the art. After application of the tobacco smoke modifying agent(s) and/or selective removal additive to the fibers, the combination is optionally dried by conventional procedures, for example, air drying or oven drying, especially to remove excess solvent, if present.

Filter

With this invention the spontaneously wettable web is incorporated into the filter plug like the plug wrap paper. The web may replace the plug wrap, be laminated to it, or fed separately along with it at the same speed between the plug wrap and the cellulose acetate tow core.

The need to mechanically, thermally, or chemically "bloom" the spontaneously wettable web to eliminate channeling has been eliminated by this invention. Such operations could be incorporated between the plug wraps of this invention to bloom the web prior to entry into the garniture and are included within the scope of this invention.

Furthermore, the potential exists to eliminate the hot melt adhesive now used to bond conventional plug wraps. Many possibilities exist here. Thermally bonded nonwovens containing binder fiber, binder powder, and the like are responsive to heat and can be rebonded, laminated to themselves, and laminated to other materials.

In addition, the potential exists to extend the filter capability curve, namely to lower the minimum rod weight limit. When this limit is reached with a conventional plug wrap, the low denier tow inside the filter rods springs back after cutting forming recessed ends, an intolerable phenomenon for subsequent cigarette manufacturing operations. If a laminate is used as a plug wrap, the spontaneously wettable may grip the tow and prevent spring back at lower total deniers.

Conventional processes and machinery for producing tobacco smoke filters in accordance with this invention are known in the art. For example, see U.S. Pat. No. 4,281,671, incorporated herein by reference.

Figure 18:
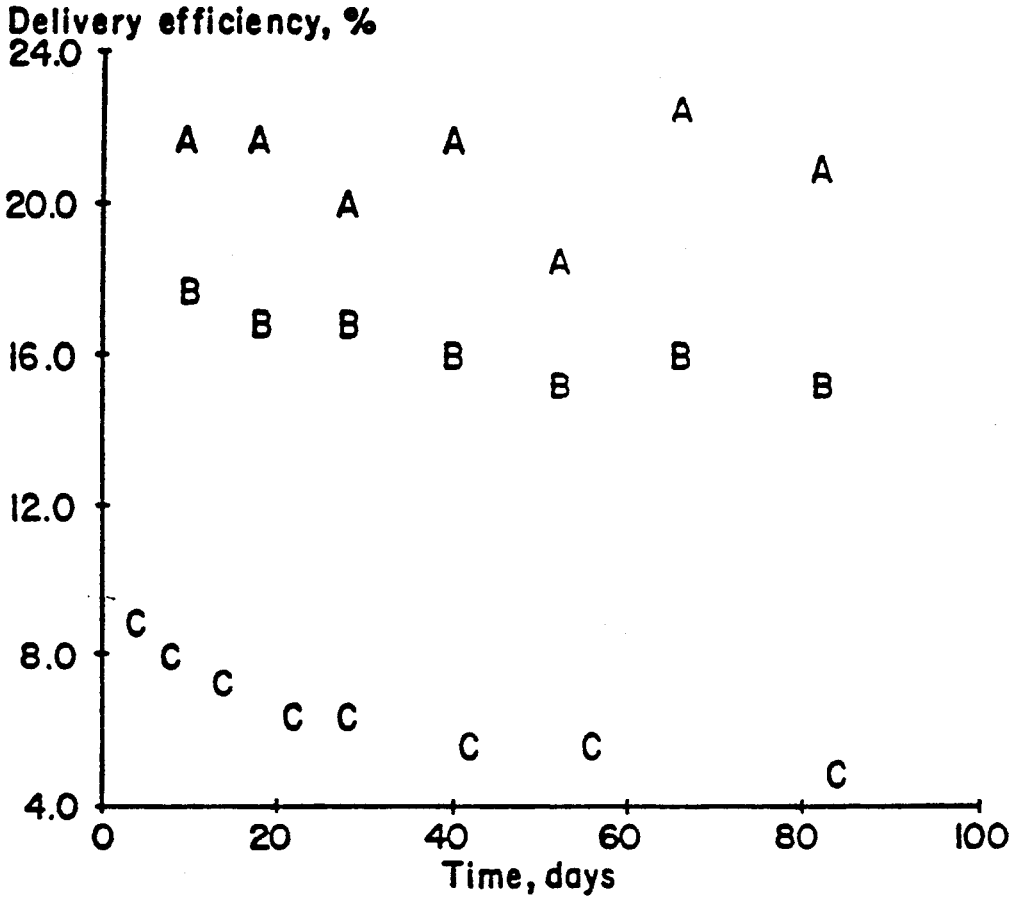
FIGS. 18 and 19 are graphs showing the performance of spontaneously wettable fibers for maintaining a constant delivery efficiency for glycerol triacetate over extended periods of storage.
Figure 19:
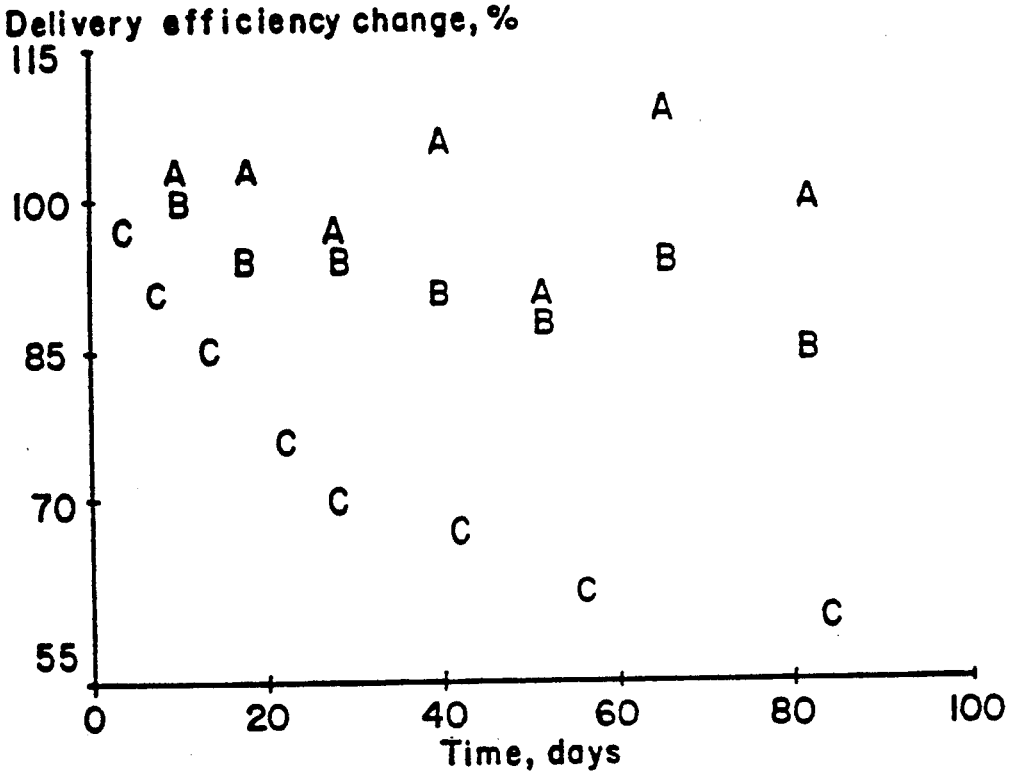
Figure 20:
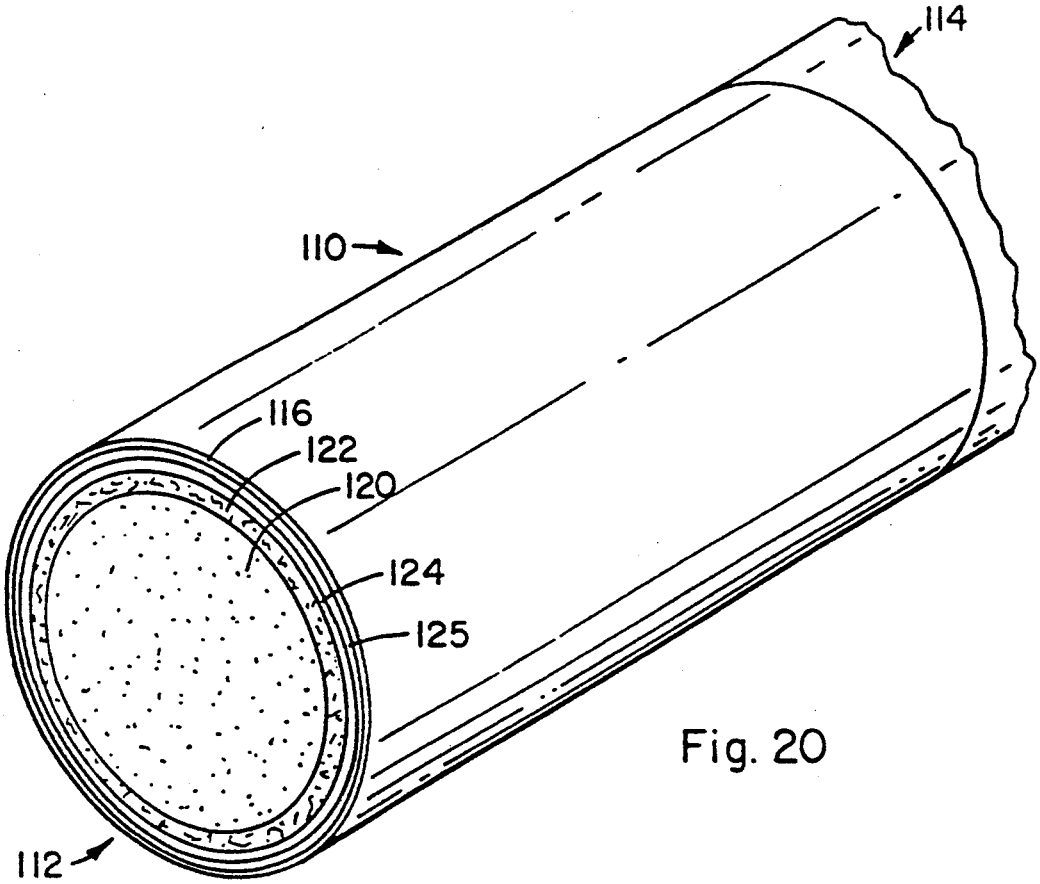
FIG. 20 is a partly sectional, partial perspective view of a cigarette including a composite filter made in accordance with this invention.
Figure 21:
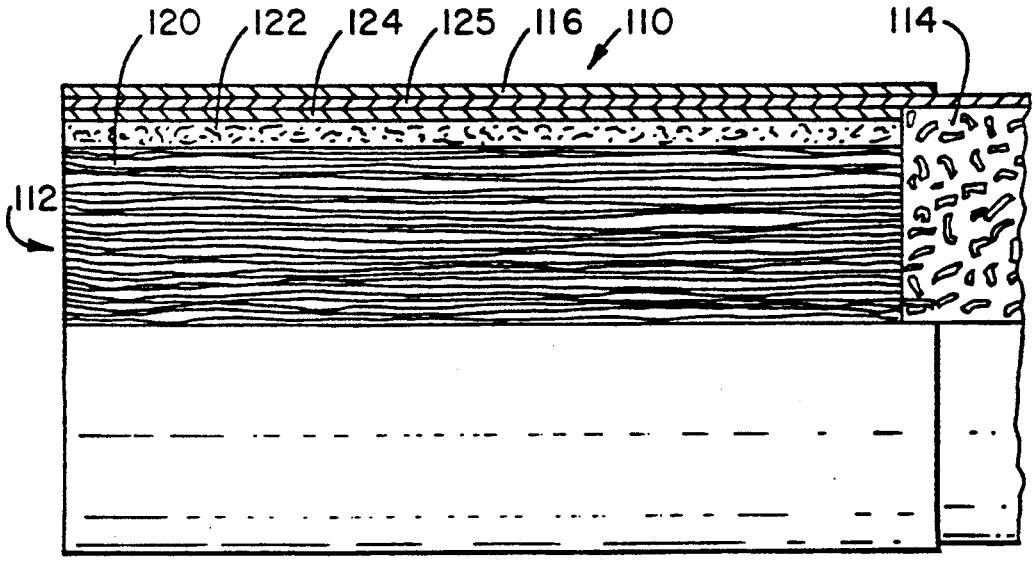
FIG. 21 is a side view, partly in section, of a cigarette including a filter made in accordance with this invention.

Referring to FIGS. 18 and 19, cigarette 110 includes a filter 112 of this invention and a tobacco rod 114 secured to filter 112 by cigarette paper 125 and tipping overwrap 116. Filter 112 includes inner member 120, outer member 122 and plugwrap 124, all of which are generally concentric with one another. Plugwrap 124 is a conventional plugwrap material such as porous paper. Cigarette paper 125 is conventional. Tipping overwrap 116 may also be conventional and may be conventionally perforated to admit dilution air to the cigarette as is well known to those skilled in the art.

Either the inner member 120 or outer member 122, preferably outer member 122, is an assemblage such as a nonwoven web or continuous tow of spontaneously wettable fibers as described herein, having thereon an application of an additive as described herein. Typical additives include agent(s) and/or selective removal additive. The inner member 120 is a conventional filter comprising a fiberous tow, such as a polymeric material. For example, the fiberous tow may be a cellulose ester such as cellulose acetate, or it may be a polyolefin.

If desired, the filter according to this invention may be used in conjunction with a conventional filter (as referred to above), e.g., it may be used in series with a conventional filter. If used in series with a conventional filter, normally the conventional filter would be at the end and the filter according to this invention would be between it and the tobacco rod 114.

The rod like article can be subdivided into segments of an appropriate length which are attached to an aerosol source such as the tobacco column of a conventional cigarette either alone or in conjunction with a conventional filter element, e.g., cellulose acetate filter incorporated herein by reference, on the mouth and so as to give the appearance of a conventional cigarette filter. The resulting improvement in flavorant delivery performance achieved by the invention is exemplified in FIGS. 1, 18 and 19 for the implementations described in Examples 14 and 15 hereof. The resulting improvement in selective delivery performance is described in Example 16 hereof.

FIG. 1 contrasts the delivery of the commonly used smoking article flavorant triacetin (glycerol triacetate) from identical fiber assemblages consisting of spontaneously wettable and non spontaneously wettable (round) fibers of comparable filament denier. The figure clearly demonstrates the substantial flavorant delivery advantage achieved by the spontaneously wettable fiber assemblage.

FIG. 18 contrasts the delivery of the commonly used smoking article flavorant triacetin (glycerol triacetate) from equal pressure drop fiber assemblages consisting of spontaneously wettable and conventional cellulose acetate fibers. This figure shows that the flavorant delivery advantage achieved by the spontaneously wettable fiber assemblage is even greater when compared to the performance of conventional cellulose acetate fibers. Furthermore, FIG. 19 shows that the delivery efficiency of the spontaneously wettable polyester fiber web filter segments for glycerol triacetate is relatively constant over extended periods of storage, whereas the delivery efficiency of the conventional cellulose acetate filter decreases significantly.

For certain tobacco smoke modifying agents, such as volatile flavorants, it may be desirable to apply such agents in a solution of a nonvolatile solvent in which the agent is highly soluble. An example of this implementation is to prepare a solution of menthol in a sufficiently nonvolatile solvent such as triacetin, polyethylene glycol, or mineral oil. The flavorant, applied as a solution to the fiber assemblage, will remain on the assemblage dissolved in the solvent but will still be spread uniformly over the fibers in a way that results in its high delivery efficiency.

The amount of tobacco smoke modifying agent in the combination of the invention (as well as assemblages made therefrom such as cigarette filters) will vary depending on, among other things, the nature of the particular fibers, the chemical nature and potency of the particular tobacco smoke modifying agent, and the desired type of delivery of the agent. However, a typical amount of tobacco smoke modifying agent is about 0.001 to about 100 percent, based on the weight of the fibers. If the tobacco smoke modifying agent is present as a solid free of solvent, a preferred amount of agent is about 0.1 to about 50%, based on the Weight of the fibers. If the tobacco smoke modifying agent is present as a liquid, a preferred amount of agent is about 0.1 to about 10%, based on the weight of the fiber.

Regarding total delivery of tobacco smoke modifying agent, the combination of the invention in a single component cigarette filter form preferably results in at least a 10% improvement, more preferably at least a 30% improvement, in delivery of such agent to the user as compared to a control filter using fibers of round cross-section.

The selective removal additives useful in the present invention are specific chemical compounds or mixtures of compounds that are applied to filter fibers to enhance the removal of certain compounds or classes of compounds from cigarette smoke. Selective removal additives may be fluids or solids. If solids are used, they are frequently applied to the filter medium as a solution in an appropriate solvent or as a suspension in an appropriate fluid medium.

Examples of fluid selective removal additives which are useful for removal of phenols include polyols and their esters such as diethyl citrate, glycerol triacetate, triethylene glycol diacetate, poly(ethylene glycol) 400 or 600, and triethylene glycol.

Examples of fluid selective removal additives which are useful for removal of nicotine are glycerin and distilled monoglycerides derived from edible fats and glycerine, such as Myverol (trademark) and Myvatem (trademark) sold by Eastman Chemical Company, a division of Eastman Kodak Company, Kingsport, Tenn.

Examples of solid selective removal additives that can be applied as solutions or suspensions in the appropriate fluid include salcomine, which is useful for selectively removing nitrogen oxides, zinc oxide, which is useful for selectively removing hydrogen cyanide, polyethyleneimine, which is useful for selectively removing aldehydes. Other generally useful additives include activated carbon, ion exchange resins, zeolites, waxes or starches.

The following examples are to illustrate the invention but should not be interpreted as a limitation thereon.

EXAMPLES

EXAMPLE 1 (Fiber Preparation)

Figure 9:
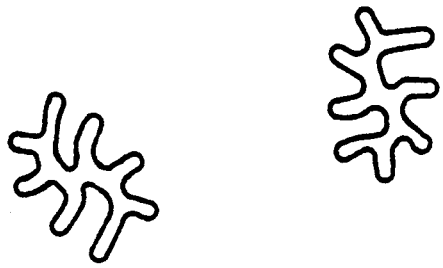
FIG. 9—photomicrograph of a poly(ethylene terephthalate) fiber cross-section made using a spinneret having an orifice as illustrated in FIG. 3 (specific dimensions of spinneret orifice described in Example 1).

Poly(ethylene terephthalate) (PET) polymer of 0.6 I.V. was used in this example. I.V. is the inherent viscosity as measured at 25° C. at a polymer concentration of 0.50 g/100 milliliters (mL) in a suitable solvent such as a mixture of 60% phenol and 40% tetra-chloroethane by weight. The polymer was dried to a moisture level of ≦0.003 weight percent in a Patterson Conaform dryer at 120° C. for a period of 8 hours. The polymer was extruded at 283° C. through an Egan extruder, 1.5-inch diameter, with a length to diameter ratio of 28:1. The fiber was extruded through an eight orifice spinneret wherein each orifice is as shown in FIG. 3 wherein W is 0.084 mm, $X_2$ is 4W, $X_4$ is 2W, $X_6$ is 6W, $X_8$ is 6W, $X_{10}$ is 7W, $X_{12}$ is 9W, $X_{14}$ is 10W, $X_{16}$ is 11W, $X_{18}$ is 6W, $\theta_2$ is 0°, $\theta_4$ is 45°, $\theta_6$ is 30°, and $\theta_8$ is 45°. The polymer throughput was about 7 pounds (lb)/hour. The air quench system has a cross-flow configuration. The quench air velocity at the top of the screen was an average of 294 feet (ft)/minute. At a distance of about 7 inches from the top of the screen the average velocity of the quench air was about 285 ft/minute, and at a distance of about 14 inches from the top of the screen the average quench air velocity was about 279 ft/minute. At about 21 inches from the top of the air screen the average air velocity was about 340 ft/minute. The rest of the screen was blocked. Spinning lubricant was applied via ceramic kiss rolls. The lubricant has a general composition as follows: it is a potassium lauryl phosphate (PLP) based lubricant having poly(ethylene glycol) 600 monolaurate (70% by weight) and polyoxyethylene (5) potassium lauryl phosphate (30% by weight). An emulsion of the above lubricant with water (90%) was used as the spinning lubricant. The lubricant level on the fiber samples was about 1.5%. Fibers of 20 dpf (denier per filament) were wound at 3,000 meters per minute (MPM) on a Barmag SW4SL winder. A photomicrograph of a cross-section of this fiber is shown in FIG. 9 (150× magnification). The single fiber was tested for spontaneous surface transportation of an aqueous solution which was aqueous Syltint Poly Red (obtained from Milliken Chemicals) which is 80 weight % water and 2 weight % red colorant. The single fiber of 20 dpf spontaneously surface transported the above aqueous solution. The following denier per filament PET fibers were also made at different speeds as shown in Table 1 below:

TABLE

| dpf | Spin Speed (MPM) | Winder |
|---|---|---|
| 20 | 3,000 | Barmag |
| 40 | 1,500 | Leesona |
| 60 | 1,000 | Leesona |
| 120 | 500 | Leesona |
| 240 | 225 | Leesona |
| 400 | 150 | Leesona |

All the single fibers of above PET fiber with the dpf of 20, 40, 60, 120, 240, and 400 spontaneously surface transported the aqueous solution of Syltint Poly Red liquid. The value of the "X" parameter (as defined hereinbefore) for these fibers was about 1.7. PET film of 0.02 inch thickness was compression molded from the same polymer as that used for making the above fiber. Contact angle of distilled water on the above film was measured in air with a contact angle goniometer. The contact angle was 71.7°. Another sample of the same film as above was sprayed with the same lubricant as used for making the fiber in this example at about 1.5% level. The contact angle of distilled water on the PET film sprayed with the lubricant was about 7°. Thus, the factor $(1-X \cos 'q)$ in this case is $(1-1.7(\cos 7°)) = -0.69$, which is less than zero.

EXAMPLE 2 (Fiber Preparation)

Figure 11:
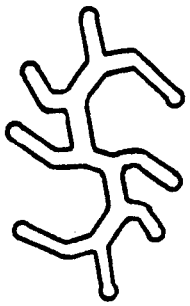
FIG. 11—photomicrograph of a nylon 66 fiber cross-section made using a spinneret having an orifice as illustrated in FIG. 3 (specific dimensions of spinneret orifice described in Example 2).

Polyhexamethylene adipamide (nylon 66) was obtained from Du Pont [Zytel (trademark) 42]. The polymer was extruded at 279° C. A spinneret as shown in FIG. 3 was used to form 46 dpf fiber at 255 meters/minute speed. The specific dimensions of the spinneret orifices were the same as described in Example 1 except that $\theta_2$ was 30° instead of 0°. The quenching conditions were the same as those for obtaining PET fiber as in Example 1. A photomicrograph of the fiber cross-section is shown in FIG. 11 (150× magnification). The lubricant level on the fiber was about 1.8% by weight. The same lubricant as used in the PET fiber was used (Example 1). This nylon 66 fiber spontaneously transported the aqueous Syltint Poly Red solution on the fiber surface. The value of the "X" parameter for this fiber was about 1.9. Nylon 66 film of 0.02 inch thickness was compression molded from the same polymer as that used for making the fiber of Example 2. Contact angle of distilled water on the above film was measured in air with a contact angle goniometer. The contact angle was 64°. Another sample of the same film as above was sprayed with the same lubricant as used for making the fiber in this example at about the 1.8% level. The contact angle of distilled water on the nylon 66 film sprayed with the lubricant was about 2°. Thus, the factor $(1-X\cos\theta)$ in this case is $(1-1.9(\cos 2°))=-0.9$, which is less than zero.

EXAMPLE 3 (Fiber Preparation)

Figure 10:
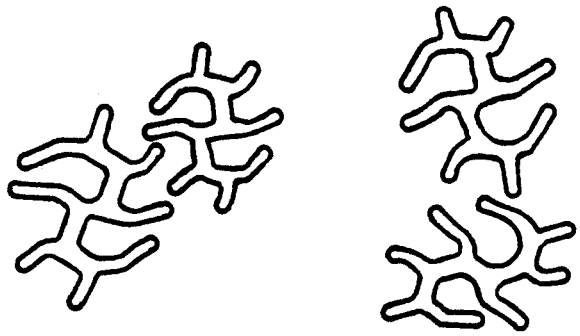
FIG. 10—photomicrograph of a polypropylene fiber cross-section made using a spinneret having an orifice as illustrated in FIG. 3 (specific dimensions of spinneret orifice described in Example 2).

Polypropylene polymer was obtained from Shell Company (Grade 5C14). It was extruded at 279° C. A spinneret as shown in FIG. 3 was used to form 51 dpf fiber at 2,000 MPM speed. The specific dimensions of the spinneret orifices were the same as in Example 2. The quenching conditions were the same as those for obtaining PET fiber. A photomicrograph of the fiber cross-section is shown in FIG. 10 (375× magnification). The lubricant level on the fiber was 2.6%. The same lubricant as used in PET fiber was used (Example 1). The polypropylene fiber spontaneously transported the aqueous Syltint Poly Red solution on the fiber surface. This spontaneously transportable phenomenon along the fiber surface was also observed for a 10 dpf, single polypropylene fiber. The value of the "X" parameter for this fiber was about 2.2. Polypropylene film of 0.02 inch thickness was compression molded from the same polymer as that used for making the above fiber of Example 3. Contact angle of distilled water on the above film was measured in air with a contact angle goniometer. The contact angle was about 110°. Another sample of the same film as above was sprayed with the same lubricant as used for making the fiber in this example at about the 2.6% level. The contact angle of distilled water on the polypropylene film sprayed with the lubricant was 12°. Thus, the factor $(1-X\cos\theta)$ in this case is $-1.1$, which is less than zero.

EXAMPLE 4 (Fiber preparation)

Cellulose acetate (Eastman Grade CA 398-30, Class I) was blended with PEG 400 polymer and small quantities of antioxidant and thermal stabilizer. The blend was melt extruded at 270° C. A spinneret as shown in FIG. 3 was used to form 115 dpf fiber at 540 meters/minute speed. The specific dimensions of the spinneret orifices were the sa==as in Example 2. No forced quench air was used. The lubricant level on the fiber Was 1.6%. The same lubricant as used in the PET fibers (Example 1) was used. The cellulose acetate fiber spontaneously transported the aqueous Syltint Poly Red solution on the fiber surface. The value of the "X" parameter for this fiber was about 1.8.

EXAMPLE 5 (Comparative)

PET fiber of Example 1 was made without any spinning lubricant at 20 dpf. A single fiber did not spontaneously transport the aqueous Syltint Poly Red solution along the fiber surface.

EXAMPLE 6 (Comparative)

PET fiber of circular cross section was made. The denier per filament of the fiber was 20. It had about 1.5% of the lubricant used in Example 1. A single fiber did not spontaneously transport the aqueous Syltint Poly Red solution along the fiber surface.

EXAMPLE 7 (Fiber Preparation)

Poly(ethylene terephthalate) (PET) fiber of Example 5 (without any spinning lubricant) was treated with oxygen plasma for 30 seconds. Model "Plasmod" oxygen plasma equipment was used. Exciter power is provided by the RF generator operating at 13.56 MHz frequency. The plasma treatment was conducted at a constant level of 50 watts power. The oxygen plasma treated fiber spontaneously transported the aqueous Syltint Poly Red solution along the fiber. This fiber was tested again after washing five times and after 3 days and the spontaneously transportable behavior with the above aqueous solution was still observed. In order to determine the reduction in contact angle after the plasma treatment, a PET film of the same material as that of the fiber was subjected to the oxygen plasma treatment under the same conditions as those used for the fiber sample. The average contact angle of the oxygen plasma treated film with distilled water in air was observed to be 26° as measured by a contact angle goniometer. The corresponding contact angle for the control PET film (not exposed to the oxygen plasma) was 70°. The significant reduction in contact angle upon subjecting the untreated PET fiber to the oxygen plasma treatment renders it to be spontaneously surface transportable for aqueous solutions.

EXAMPLE 8 (Fiber Preparation)

Figure 12:
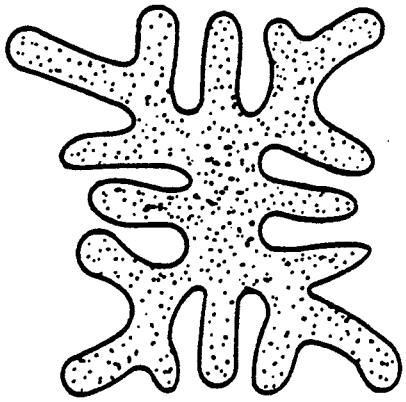
FIG. 12—schematic representation of a poly(ethylene terephthalate) fiber cross-section made using a spinneret having an orifice as illustrated in FIG. 4 (specific dimensions of spinneret orifice described in Example 8).

Poly(ethylene terephthalate) (PET) polymer of 0.6 IV was used in this example. It was extruded through a spinneret having eight orifices as shown in FIG. 4 wherein W is 0.084 mm, $X_{20}$ is 17W, $X_{22}$ is 3W, $X_{24}$ is 4W, $X_{26}$ is 60W, $X_{28}$ is 17W, $X_{30}$ is 2W, $X_{32}$ is 72W, $\theta_{10}$ is 45°, Leg B is 30W, and Leg A is 26W. The rest of the processing conditions were the same as those described in Example 1. A 100 dpf fiber was spun at 600 MPM. A sketch of the cross-section of the fiber is shown in FIG. 12. The lubricant level on the fiber was about 1%. The same lubricant as used in Example 1 was used. The above fiber spontaneously transported the aqueous Syltint Poly Red solution along the fiber surface. The value of the "X" parameter for this fiber was 1.5.

EXAMPLE 9 (Fiber Preparation)

Figure 13:
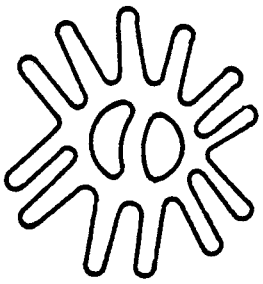
FIG. 13—photomicrograph of a poly(ethylene terephthalate) fiber cross-section made using a spinneret having an orifice as illustrated in FIG. 5 (specific dimensions of spinneret orifice described in Example 9).

Poly(ethylene terephthalate) polymer of 0.6 IV was used in this example. It was extruded through a spinneret having eight orifices as shown in FIG. 5 wherein W is 0.10 mm, $X_{34}$ is 2W, $X_{36}$ is 58W, $X_{38}$ is 24W, $\theta_{12}$ is 20°, $\theta_{14}$ is 28°, and n is 6. The rest of the extruding and spinning conditions were the same as those described in Example 1. A photomicrograph of the fiber cross-section is shown in FIG. 13 (585× magnification). A 20 dpf fiber was spun at 3000 MPM. The lubricant level on the fiber was about 1.7%. The same lubricant as used in Example 1 was used. The above fiber spontaneously transported the aqueous Syltint Poly Red solution along the fiber surface. The value of the "X" parameter for this fiber was about 2.4.

EXAMPLE 10 (Fiber Preparation)

Figure 14:
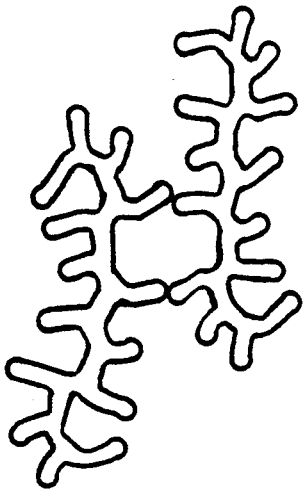
FIG. 14—photomicrograph of a poly(ethylene terephthalate) fiber cross-section made using a spinneret having an orifice as illustrated in FIG. 7 (specific dimensions of spinneret orifice described in Example 10).

Poly(ethylene terephthalate) (PET) polymer of about 0.6 IV was used in this example. The polymer was extruded through a spinneret having four orifices as shown in FIG. 7 wherein the dimensions of the orifices are repeats of the dimensions described in Example 2. The rest of the processing conditions were the same as those described in Example 1 unless otherwise stated. A 200 dpf fiber was spun at 600 MPM. The polymer throughput was about 7 lbs/hr. An optical photomicrograph of the fiber is shown in FIG. 14 (150× magnification). The lubricant level on the fiber was 2.0%. The same lubricant as used in Example 1 was used. The above fiber spontaneously transported the aqueous Syltint Poly Red solution along the fiber surface. The value of the "X" parameter for this fiber was about 2.2.

EXAMPLE 11 (Fiber Preparation)

Figure 8:
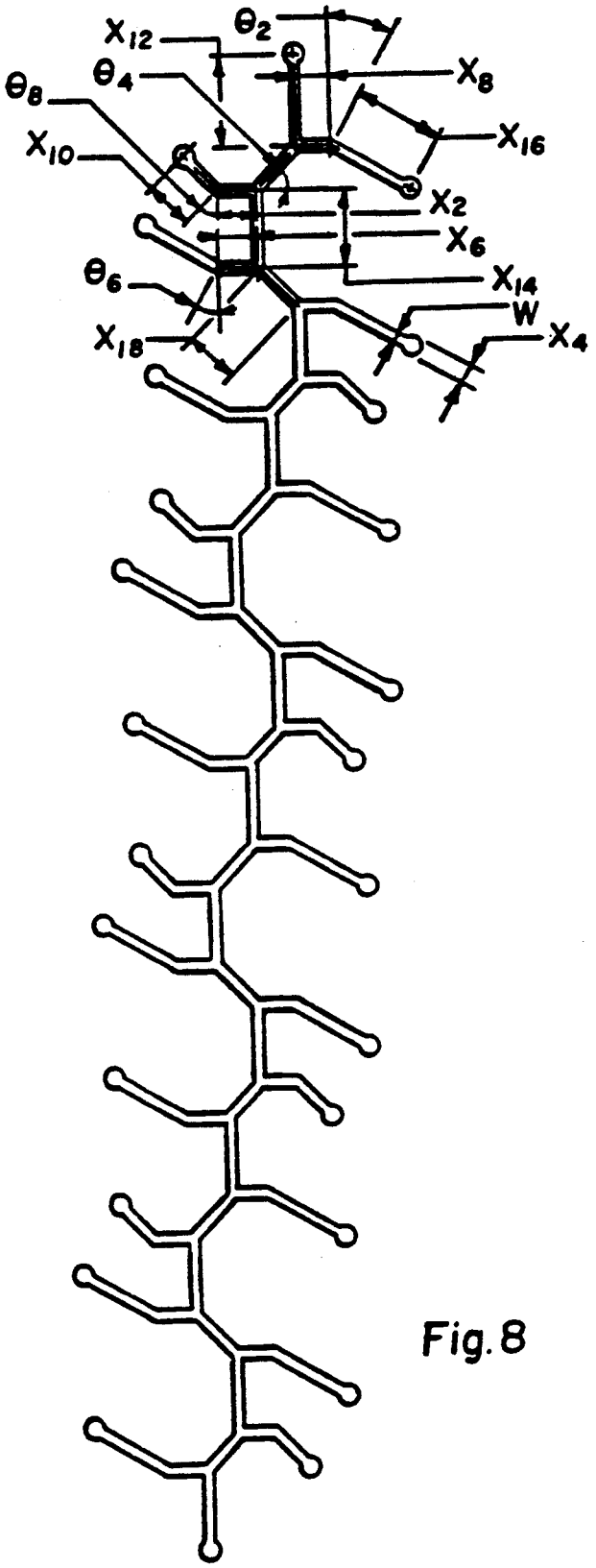
FIG. 8—schematic representation of an orifice of a spinneret having 4 repeating units, joined end to end, of the orifice as shown in FIG. 3.
Figure 15:
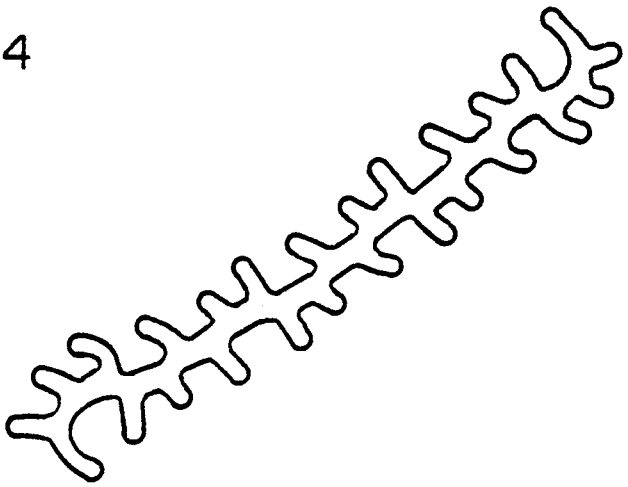
FIG. 15—photomicrograph of a poly(ethylene terephthalate) fiber cross-section made using a spinneret having an orifice as illustrated in FIG. 8 (specific dimensions of spinneret orifice described in Example 11).

Poly(ethylene terephthalate) (PET) polymer of 0.6 IV was used in this example. The polymer was extruded through a spinneret having two orifices as shown in FIG. 8 wherein the dimensions of the orifices are repeats of the dimensions described in Example 2. The rest of the processing conditions were the same as those described in Example 1. A 364 dpf fiber was spun at 600 MPM. The cross section of the fiber is shown in FIG. 15 (150× magnification). The lubricant level on the fiber was about 2.7%. The same lubricant as used in Example 1 was used. The above fiber spontaneously transported the aqueous Syltint Poly Red solution along the fiber surface. The value of the "X" parameter for this fiber was 2.1.

Figure 17:
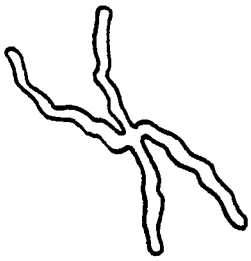
FIG. 17—photomicrograph of a poly(ethylene terephthalate) fiber cross-section made using a spinneret having an orifice as illustrated in FIG. 6 (specific dimensions of spinneret orifice described in Example 12).

EXAMPLE 12 (Fiber Preparation)

poly(ethylene terephthalate) (PET) polymer of 0.6 IV was used in this example. It was extruded through a spinneret having eight orifices as shown in FIG. 6 wherein W is 0.10 mm, $X_{42}$ is 6W, $X_{44}$ is 11W, $X_{46}$ is 11W, $X_{48}$ is 24W, $X_{50}$ is 38W, $X_{52}$ is 3W, $X_{54}$ is 6W, $X_{56}$ is 11W, $X_{58}$ is 7W, $X_{60}$ is 17W, $X_{62}$ is 28W, $X_{64}$ is 24W, $X_{66}$ is 17W, $X_{68}$ is 2W, $\theta_{16}$ is 45°, $\theta_{18}$ is 45°, and $\theta_{20}$ is 45°. The rest of the processing conditions were the same as those described in Example 1. A 100 dpf fiber was spun at 600 MPM. The cross-section of the fiber is shown in FIG. 17. The lubricant level on the fiber was about 1%. The same lubricant as used in Example 1 was used. The above fiber spontaneously transported the aqueous Syltint Poly Red solution along the fiber surface. The value of the "X" parameter for this fiber was 1.3.

EXAMPLE 13 (Fiber Preparation)

Figure 17B:
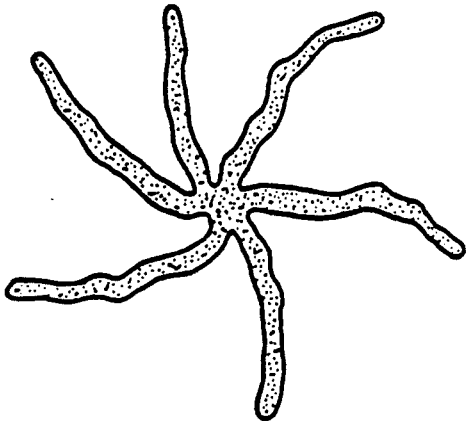
FIG. 17B—schematic representation of a poly(ethylene terephthalate) fiber cross-section made using a spinneret having an orifice as illustrated in FIG. 6B (specific dimensions of spinneret orifice described in Example 13).

PET polymer of 0.6 I.V. is used in this example. It is extruded through a spinneret having 8 orifices as shown in FIG. 6B wherein W is 0.10 mm, $X_{72}$ is 8W, $X_{74}$ is 8W, $X_{76}$ is 12W, $X_{78}$ is 8W, $X_{80}$ is 24W, $X_{82}$ is 18W, $X_{84}$ is 8W, $X_{86}$ is 16W, $X_{88}$ is 24W, $X_{90}$ is 18W, $X_{92}$ is 2W, $\theta_{22}$ is 135°, $\theta_{24}$ is 90°, $\theta_{26}$ is 45°, $\theta_{28}$ is 45°, $\theta_{30}$ is 45°, $\theta_{32}$ is 45°, $\theta_{34}$ is 45°, $\theta_{36}$ is 45° and $\theta_{38}$ is 45°. A 20 denier per filament fiber is spun at 3,000 m/min. The rest of the processing conditions are the same as those used in Example 1. The lubricant level on the fiber is about 1%. The cross-section of the fiber is shown in FIG. 17B. This fiber spontaneously transports the aqueous Syltint Poly Red solution along the fiber surface. The "X" value for this fiber is about 2.1.

EXAMPLE 14 (Example of the Invention)

Spontaneously wettable polyester fibers were melt spun from polyethylene terephthalate polymer according to the methods described in Example 1. The value of the X parameter (as defined hereinbefore) for these fibers was about 1.8. A yarn of these fibers was then drafted to 5.5 denier per filament, heat set at about 180° C., crimped to about 7 or 8 crimps per inch (25.4 mm), and cut into 2-inch (50.8 mm) long staple fibers. The resulting staple fibers were carded and bonded with about 15 weight % Eastobond (trademark) FA-252 polyester adhesive in powder form into a nonwoven web with a density of about 19 grams per square yard (22.71 grams/square meter). Round cross section fiber webs to be used as controls were made by an identical process except that the fibers were melt spun through spinneretts with round holes.

The resulting round and spontaneously wettable polyester fiber webs were slit lengthwise into pieces approximately 12 inches (304.80 mm) wide which Were then cut into 24-inch (609.60 mm) long sections. The resulting 12-inch (304.80 mm) wide by 24-inch (609.60 mm) long web sections weighed approximately 4 grams each. Glycerol triacetate, also referred to as triacetin flavorant, either in its pure form or as a 10, 20, or 50 weight % solution in ethanol, was applied in roughly equal quantities to both round and spontaneously wettable fiber web sections using an aerosol sprayer. The web sections were air dried overnight to remove the residual ethanol.

The dried web sections were pulled lengthwise into drinking straws which Were about 23 mm in circumference and each straw was cut into 21-mm long segments. The 21-mm long round fiber web filled straw segments contained about 150 mg of web and had an average pressure drop of about 28 mm of water when measured at a flow rate of 17.5 cc/sec. of air. The 21-mm long spontaneously wettable fiber web filled straw segments also contained about 150 mg of web but had an average pressure drop of about 55 mm of water when measured at a flow rate of 17.5 cc/sec. of air. Each 21-mm segment contained between 2 and 18 mg of glycerol triacetate depending upon the application rate.

The 21-mm long web filled straw segments were then attached to 63-mm long blended tobacco columns that had been cut off a popular king-sized domestic cigarette brand, and the resulting cigarettes were smoked according to CORESTA Standard Method No. 10 entitled "Machine Smoking of Cigarettes and Determination of Crude and Dry Smoke Condensate". Experimental cigarettes were smoked in groups such that one glass fiber filter pad was used to collect the smoke condensate from five cigarettes. Each glass fiber filter pad was then extracted with 15 ml of isopropanol containing 0.4 mg/ml hexadecane as an internal standard. The glycerol triacetate present in the isopropanol extract of the condensate from each glass fiber pad was then quantitatively determined by capillary gas chromatography.

The performance of the invention for delivering glycerol triacetate is reported in FIG. 1. The reported delivery efficiency is defined as the percentage of the flavorant present on the fiber web filled straw segment before smoking that was delivered to the glass fiber filter pad by smoking the experimental cigarettes. The term "4SW" represents fibers capable of spontaneously transporting water on the surfaces thereof.

EXAMPLE 15 (Example of the Invention)

Spontaneously wettable polyester fibers were melt spun from polyethylene terephthalate polymer according to the methods described in Example 1. The value of the X parameter (as defined hereinbefore) for these fibers was about 1.7. A yarn of these fibers was then drafted to 10.3 denier per filament, heat set at about 180 degrees centigrade, crimped to about 7 or 8 crimps per inch (24.4 mm), lubricated with poly(ethylene) 600 monolaurate lubricant, and cut into 2 inch (50.8 mm) long staple fibers. The spontaneously wettable staple fibers were blended with about 20 weight % Kodel (trademark) 410 amorphous polyester binder fiber, carded and thermally bonded into a nonwoven web with a density of about 35 grams per square yard (41.53 grams/square meter). The resulting web was then slit into sections 9.4 inches (238.76 mm) wide and wound onto rolls about 1000 linear yards (914.40 meters) long.

Rolls of spontaneously wettable polyester fiber web were processed into filter rods in the following manner. An Eastman Miniature filter tow processing unit was used to unwind the web from the roll, to quantitatively apply glycerol triacetate to the web at each of the two target application rates, and to control the rate of delivery of the web to the next step of the process. A Molins PM-2 filter rod making machine was then used to fold the web into rod shaped cylinders which were wrapped with Ecusta 646 plugwrap. The resulting filter rods were cut into 21 mm long segments which were 24.5 mm in circumference, contained about 178 mg of nonwoven web, and had an average pressure drop of about 27 mm of water when measured at a flow rate of 17.5 cc/sec of air. Depending on the rate of application, each filter segment contained either 2.4 mg or 5.6 mg of glycerol triacetate which, when expressed as a percentage of the total filter weight, corresponded to levels of 1.3 and 2.8 weight percent respectively.

As a comparison, flavored control filters were made in the conventional manner from 3.3 denier per filament, 39,000 total denier, Y cross section, Estron (trademark) solution spun cellulose acetate filter tow. The 21 mm long filter segments were 24.5 mm in circumference, contained 120 mg of filter tow, and had an average pressure drop of about 65 mm of water when measured at a flow rate of 17.5 cc/sec of air. Each filter segment contained 10.3 mg of glycerol triacetate which, when expressed as percentage of the total filter weight, corresponded to a level of 7.0 weight percent.

The spontaneously wettable polyester fiber web filter segments were then placed in sealed glass jars and stored for intervals consisting of 10, 18, 28, 39, 52, 66, and 82 days. At the end of each storage interval, the filters were attached to 63 mm long blended tobacco columns that had been cut off of a popular King sized domestic cigarette brand and the resulting cigarettes were smoked according to CORESTA Standard Method No. 10 entitled "Machine Smoking of Cigarettes and Determination of Crude and Dry Smoke Condensate". The cellulose acetate control filters were stored for intervals of 3, 7, 14, 21, 28, 42, 56, and 84 days prior to smoking.

Both experimental and control cigarettes were smoked in groups such that one glass fiber filter pad was used to collect the smoke condensate from 4 cigarettes. Each glass fiber filter pad was then extracted with 15 ml of isopropanol containing 0.4 mg/ml hexadecane as an internal standard. The glycerol triacetate present in the extract of the condensate from each glass fiber pad was then quantitatively determined by capillary gas chromatography.

FIG. 18 reports the performance of the invention for achieving consistently higher delivery efficiencies of glycerol triacetate than the control cellulose acetate filters. The delivery efficiency reported in FIG. 18 is defined as the percentage of the glycerol triacetate present on the filter segment before smoking that was delivered to the glass fiber pad by smoking the experimental and control cigarettes. FIG. 2 shows that the delivery efficiency of the spontaneously wettable polyester fiber web filter segments for glycerol triacetate was 2 to 3 times greater than the delivery efficiency of the conventional cellulose acetate filter segments initially and 3 to 4 times greater by the end of the experiment. These higher delivery efficiencies permit significant reductions in the amount of flavorant that must be used to achieve a desired delivery.

FIG. 19 reports the performance of the invention for maintaining a constant delivery efficiency of glycerol triacetate over extended periods of storage. The delivery efficiency change reported in FIG. 19 is defined as the percentage change in delivery efficiency relative to the delivery efficiency anticipated from a freshly made filter. FIG. 19 shows that the delivery efficiencies of the two spontaneously wettable polyester fiber web filter segments for glycerol triacetate are virtually independent of storage time and, therefore, show little change, whereas the conventional cellulose acetate filter segments lose almost half of their already lower delivery efficiency during the time spanned by this experiment.

EXAMPLE 16 (Example of the Invention)

Spontaneously wettable polyester fibers were melt spun from polyethylene terephthalate polymer according to the methods described in Example 1. The value of the X parameter (as defined hereinbefore) for these fibers was about 1.8. A yarn of these fibers was then drafted to 5.5 denier per filament, heat set at about 180 degrees centigrade, crimped to about 7 or 8 crimps per inch (25.4 mm), and cut into 2 inch (50.8 mm) long staple fibers. The resulting staple fibers were carded and bonded with about 15 weight % Eastobond FA-252 polyester adhesive powder into a nonwoven web with a density of about 19 grams per square yard (22.71 grams/square meter). Round cross section fiber webs to be used as controls were made by an identical process except that the fibers were melt spun through spinnerets with round holes.

The resulting round and spontaneously wettable polyester fiber webs were slit lengthwise to widths of 15 and 12 inches (381.00 and 304.80 mm), respectively. the round webs were slit to a wider width in order to better match the pressure drops of the resulting filters. Selective removal additives consisting of either glycerol triacetate or poly(ethylene glycol) 600 were applied to each web at a level of 7 weight percent using an aerosol sprayer. Glycerol triacetate was applied to the webs in pure form but, because of its higher viscosity, poly(ethylene glycol) 600 was applied as a 10% aqueous solution. The poly(ethylene glycol) 600 treated webs were dried in an oven at 60 degrees centigrade for 1 hour after spraying to remove excess water. All of the treated webs were allowed to air dry overnight to remove residual volatiles.

The dried web sections were pulled lengthwise into drinking straws which were about 23 mm in circumference and each straw was cut into several 21 mm long segments. Filters were made in this manner to achieve a target pressure drop of about 70 mm of water when measured at a flow rate of 17.5 cc/sec of air. Because of differences in the relative abilities of the round and 4SW fiber webs to generate pressure drop, filters made from these two types of web contained different quantities of coated substrate. To achieve the target pressure drop, 21 mm long filters required about 210 mg of coated round fiber PET web and about 160 mg of coated 4SW fiber web.

As an additional comparison, straw filters were also made from a 3.3 denier per filament, 39,000 total denier, Y cross section, Estron solution spun cellulose acetate filter tow that had been treated with either glycerol triacetate or poly(ethylene glycol) 600. The resulting 21 mm long filter tips were 23 mm in circumference, contained about 130 mg of treated cellulose acetate filter tow, and had an average pressure drop of about 75 mm of water when measured at a flow rate of 17.5 cc/sec of air. Each filter segment contained between 8 and 9 mg of either glycerol triacetate or poly(ethylene glycol) 600 which, expressed as percentage, corresponds to an application level of 7.0 weight percent.

The 21 mm long treated straw filters were attached to 63 mm long blended tobacco columns that had been cut off of a popular King sized domestic cigarette brand and the resulting cigarettes were smoked according to CORESTA Standard Method No. 10 entitled "Machine Smoking of Cigarettes and Determination of Crude and Dry Smoke Condensate". Experimental cigarettes of a given type were smoked in groups such that one glass fiber filter pad was used to collect the smoke condensate from 5 cigarettes. The selective removal efficiency of the filters was then determined by measuring the amount of phenol present in the glass fiber filter pads and the freshly smoked cigarette filters.

In order to measure the phenol present, the glass fiber filter pads and cigarette filters were both separately extracted with diethyl ether and the resulting extracts were concentrated, purified, and quantitatively measured using gas chromatography. The percentage of selective phenol removal reported herein is defined as 100 times the amount of phenol on the cigarette filters divided by the sum of the amount of phenol on the cigarette filters and the amount of phenol on the glass fiber filter pad.

The performance of the invention for the selective removal of phenol from cigarette smoke is reported in Table 1A. In all cases, the application of selective removal additives such as glycerol triacetate and poly(ethylene glycol) 600 to 4SW PET fiber web produced filters with higher selective removal efficiencies for phenol than were obtained when round PET fiber web or Estron filter tow were used as filter substrates. This superior phenol removal efficiency was obtained even though the 4SW PET fiber web filters had consistently lower pressure drops than the filters made from either round PET fiber web or Estron filter tow and lower weights than filters made from round PET fiber web.

TABLE 1A

PHENOL REMOVAL OF FILTERS CONTAINING SLECTIVE REMOVAL ADDITIVES

| | SELECTIVE REMOVAL ADDITIVE | | | | | |
|---|---|---|---|---|---|---|
| | Glycerol triacetate | | | Poly(ethylene glycol | | |
| Filter Material | Filter Weight mg | Filter P.D. mm $H_2O$ | Phenol rem. % | Filter Weight mg | Filter PD mm $H_2O$ | Phenol rem. % |
| Round PET fiber web | 208.4 | 72.2 | 65.2 | 210.5 | 70.4 | 76.3 |
| 4SW PET fiber web | 153.6 | 68.4 | 73.6 | 160.0 | 63.1 | 83.6 |
| Estron filter tow | 124.9 | 71.8 | 71.6 | 134.4 | 76.8 | 75.9 |

EXAMPLE 17 (Example of the Invention)

The purpose of this example was to compare the flavor deliveries between the invention and conventional web and tow filters. Five types of filters were prepared and tested.

Spontaneously wettable polyester fibers were melt spun from polyethylene terephthalate polymer according to the methods described in Example 1. The value of the X parameter (as defined hereinbefore) for these fibers was about 1.7. A yarn of these fibers was then drafted to 5.5 denier per filament, heat set at about 180° C., crimped to about 7 or 8 crimps per inch (25.4 mm), and cut into 2-inch (50.8 mm) long staple fibers. The resulting staple fibers were carded and bonded with about 20 weight % polyester binder fiber into a nonwoven web with a density of about one ounce per square yard (34 grams/square meter). The spontaneously wettable web was coated with the flavorant, vanillin, by submerging the web into a solution of vanillin in ethanol. The web sections were air dried overnight to remove the residual ethanol.

The web and tow segments in series filters were made in two versions to represent typical constructions for adding web into a cigarette filter (e.g., U.S. Pat. No. 4,807,809 and U.S. Pat. No. 5,076,295). To make the all web filter segments, the dried web was cut into widths of 10 inch (25.4 cm) and pulled into straws which were about 23.0 mm in circumference. In order to make a paper-wrapped all web filter, the straw was inserted into an empty tube of plugwrap paper and the plastic straw is pulled out, leaving the web inside the plug wrap paper. The resulting paper-wrapped web filters had circumferences of 24.5 mm. The filter tow filter segments were made with a Hauni KDF-2/AF-2 filter tow processing unit. The first filter type had a filter tow segment length of 22 mm and a web segment length of 5 mm which constructed a 27 mm filter tip with 151 mg of tow and 65 mg of web. The second filter type had a filter tow segment length of 15 mm and a web segment length of 12 mm. The filter made of these two segments was 27 mm in length and had roughly 110 mg of tow and 174 mg of web.

Two versions of the invention were assembled and tested. The first filter type consisted of a single wrap of vanillin-coated web around a filter tow filter. The filter tow segment had a circumference of 23.0 mm and a length of 27 mm and was made from 2.1 denier per filament/48,000 total denier/Y cross section filter tow which contained 7% glycerol triacetate plasticizer to increase filter firmness. The vanillin-coated web was the length of the filter tow segment (27 mm) and was wide enough to wrap around the tow segment once. The resulting filter was 27 mm in length with about 160 mg of tow and 25 mg of coated web. The second filter type consisted of a double wrap of the vanillin-coated web around a 2.1 denier per filament/48,000 total denier/Y cross section filter tow filter segment which had a circumference of 22.0 mm and no plug wrap paper. The web wrapped the length of the filter tow segment, with one dimension equal to the length of the segment and the other dimension equal to twice the circumference. The resulting filter was a 27 mm filter tip with 150 mg of tow and 55 mg of coated web.

The control filters were filter tow filters which were included to compare the filtration efficiency. The filter tow filter was 27 mm in length and 24.5 mm in circumference conventional filter tow filter made with 2.1 denier per filament/48,000 total denier/Y cross section filter tow. The filters contained 7% glycerol triacetate as a plasticizer to improve filter firmness, but vanillin was not added.

Each of the test filters were attached to a 63 mm long blended tobacco columns that had been cut off a popular king-size domestic cigarette brand. The resulting cigarettes were smoked according to CORESTA Standard Method No. 10 entitled "Machine Smoking of Cigarettes and Determination of Crude and Dry Smoke Condensate". Experimental cigarettes were smoked in groups such that one glass fiber filter pad was used to collect the smoke condensate from five cigarettes. Each glass fiber filter pad was then extracted with 15 ml of isopropanol containing 0.4 mg/ml anisole as an internal standard. The vanillin and glycerol triacetate present in the isopropanol extract of the condensate from each glass fiber pad was quantitatively determined by capillary gas chromatography.

The deliveries and filter properties are listed in Table 2. The results show that the invention filters have good flavorant deliveries comparable to the series filters. The advantage of the web wrapped around tow filters is that the filtration efficiency is better than with an all web filter.

TABLE 2

| Property | Filter Tow Filter | Series Filters | | Coaxial Filters | |
|---|---|---|---|---|---|
| | | Short | Long | Single | Double |
| Tow Length, mm | 27 | 22 | 15 | 27 | 27 |
| Web Length, mm | 0 | 5 | 12 | 27 | 27 |
| Tow Weight, mg | 187 | 151 | 110 | 162 | 153 |
| Web Weight, mg | 0 | 65 | 174 | 26 | 55 |
| Circumference, mm | 24.5 | 24.5 | 24.5 | 24.3 | 25.0 |
| Pressure Drop, mm | 168 | 162 | 145 | 148 | 140 |
| Tar Removal Efficiency, % | 68 | 63 | 55 | 68 | 63 |
| Nicotine Removal Eff., % | 70 | 64 | 59 | 70 | 66 |
| Vanillin Weight, mg | 0 | 12 | 30 | 4 | 14 |
| Vanillin Delivery, mg | 0 | 0.08 | 0.20 | 0.06 | 0.11 |
| Glycerol Triacetate Delivery, mg | 0.32 | 0.20 | 0.20 | 0.29 | 0.29 |

EXAMPLE 18 (Example of the Invention)

The purpose of this example was to compare the tar removal efficiency of the invention to conventional filter tow filters and all web filters.

All web filters and coaxial web/tow filters were made as described in Example 17 and the filter's pressure drop and circumferences were measured. Handmade cigarettes were made using a tobacco column from a popular king-size domestic cigarette brand. The resulting cigarettes were smoked according to CORESTA Standard Method No. 10 entitled "Machine Smoking of Cigarettes and Determination of Crude and Dry Smoke Condensate". The experimental cigarettes were smoked in groups such that one glass fiber filter pad was used to collect the smoke condensate from five cigarettes. The removal efficiency was calculated by measuring the absorbance at 360 nm of a isopropanol extraction of both the glass fiber filter pad and test filters. The removal efficiency is the absorbance from the filter's extract divide by the absorbance from the filter's extract and the glass fiber filter pad's extract.

Figure 22:
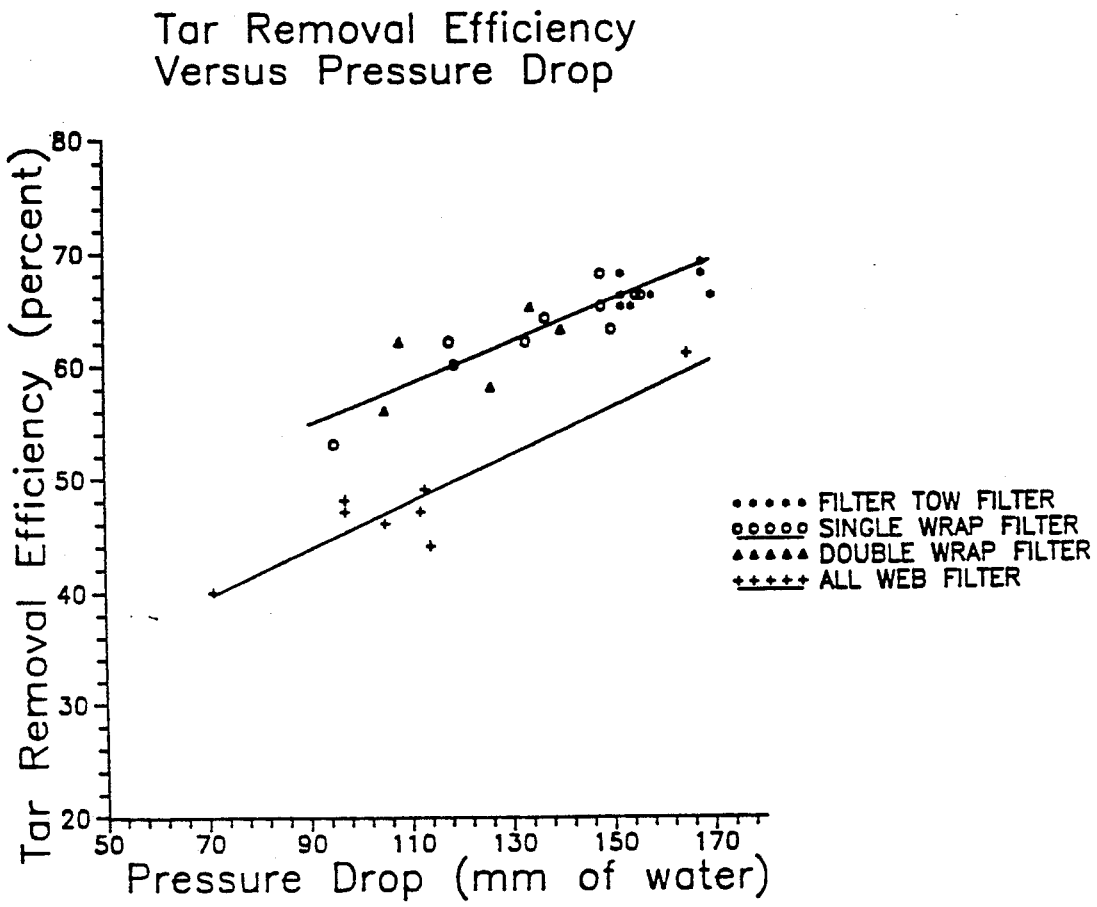
FIG. 22—a graph wherein tar removal efficiency is plotted versus pressure drop for conventional tow filters, filters of the invention having single and double wraps of spontaneously wettable fiber around filter tow, and filters made using only web which contains the spontaneously wettable filters.

The results of testing of several filters for pressure drop and removal efficiency is shown in FIG. 22. This graph clearly illustrates the performance difference between the types of filter constructions. The filter tow filters have good removal efficiency, whereas the all web filters have relatively poor removal efficiency. The all web filter's poorer filterability is probably caused by the channels which result from the folding of the web inside the filter. The coaxial filter with the web wrapped around the tow does not have channels and makes better smoke filters.

EXAMPLE 19 (Example of the Invention)

The purpose of this example was to perform a taste comparison of the invention to conventional filter tow filters.

Web was made according the methods described in Example 17. The web was coated with a flavor enhancing tobacco extract. The 25 mm flavor enhancing filter segment was made by wrapping the tobacco extract coated, spontaneously wettable web around the outside of a conventional filter tow filter from which the plug wrap paper has been removed. The filter tow filter segment had a length of 25 mm, a circumference of 22.0 mm, and was made from 2.1 denier per filament/48,000 total denier/Y cross section filter tow. The tobacco extract coated web wraps the entire length of the filter tow segment, with one dimension equal to the length of the segment and the other dimension equal to twice the circumference allowing two wraps around the filter tow filter segment. King size 85 mm cigarettes with flavor enhancement were handmade by combining a 25 mm flavor enhancing novel filter segment with a 2 mm conventional filter tow filter segment used at the mouth end to hide the novel construction from the smoke taste tester. The cigarette's properties were measured as pressure drop equals 144 mm of water, tar removal efficiency was 61%, Federal Trade Commission (FTC) tar delivery is 7 mg, and nicotine delivery was 0.5 mg.

Control cigarettes were made to a matching tar delivery and appearance by combining 8 mm empty straw and a 19 mm filter segment consisting of a 2.1 denier per filament/48,000 total denier/Y cross section filter tow. The filter was ventilated to 12% to match the above test cigarette. The cigarette's properties were pressure drop equals 150 mm of water, tar removal efficiency was 56%, FTC tar delivery was 8 mg, and nicotine delivery was 0.6 mg.

The cigarette with the tobacco extract coated web was preferred by smoke taste testers and show that an additive added to a web wrapped around a tow filter will improve the taste of cigarette smoke.

The invention has been described in detail with particular reference to the preferred embodiments thereof, but it will be understood that variations and modifications can be effected within the spirit and scope of the invention. All of the U.S. patents cited herein are hereby incorporated herein by reference in their entirety.

We claim:

1. A filter comprising a generally cylindrical inner member, an outer member generally concentrically surrounding said inner member and a plugwrap generally concentrically surrounding said outer member, either said inner member or said outer member being a filter element of tow having filaments extending in an axial direction with respect to said filter, and the other of said inner member or outer member comprising at least one fiber having at least one continuous groove which is capable of spontaneously transporting n-decane on the surface thereof wherein said fiber satisfies the equation $$(1-X\cos\theta_a)<0,$$

wherein $\theta_a$ is the advancing contact angle of n-decane measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section, and at least one tobacco smoke modifying agent in combination with said fiber.

2. A filter comprising a generally cylindrical inner member, an outer member generally concentrically surrounding said inner member and a plugwrap generally concentrically surrounding said outer member, said inner member being a filter element of tow having filaments extending in an axial direction with respect to said filter, and said outer member comprising at least one fiber having at least one continuous groove which is capable of spontaneously transporting n-decane on the surface thereof wherein said fiber satisfies the equation $$(1-X\cos\theta_a)<0,$$

wherein $\theta_a$ is the advancing contact angle of n-decane measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section, and at least one tobacco smoke modifying agent in combination with said fiber.

3. A filter according to claim 2 wherein said outer member is a web of said fibers.

4. A filter according to claim 2 wherein said outer member is a nonwoven web of said fibers.

5. A filter according to claim 2 wherein said inner member is a conventional cellulose acetate fibers.

6. The combination of claim 2 wherein for said fiber $2_D{}^4$ is greater than 1.

7. The combination of claim 2 wherein for said fiber X is greater than about 1.2.

8. The filter of claim 2 wherein said fiber has a single fiber denier of between 1 and 100.

9. The filter of claim 2 wherein said fiber is comprised of a material selected from the group consisting of a polyester, polypropylene, polyethylene, a cellulose ester, and a nylon.

10. The filter of claim 2 wherein said tobacco smoke modifying agent is a hydrophobic or hydrophilic material.

11. The filter of claim 2 wherein said tobacco smoke modifying agent is a flavorant, a synergistic flavor enhancer, a physiological coolant or another mouth or throat stimulant.

12. The filter of claim 2 wherein said tobacco smoke modifying agent is an aqueous tobacco extract, aromatic tobacco extract, rum, coumarin, honey, vanilla, wine, juniper, molasses, maple syrup, chocolate, menthol, sugars, vanillin, licorice, anethole, anise, cocoa, cocoa and chocolate by products, sugars, humectants, eugenol, clove oil, triacetin, glutamates, nucleotides, 2-cyclohexylcyclohexanone, mint oil, methanol, camphor, camphoraceous compounds, menthol derivatives, or nicotine or its derivatives.

13. The filter of claim 2 wherein the amount of said modifying agent is about 0.001 to about 100 percent based on the weight of said fiber.

14. The combination of claim 13 wherein said fiber has a single fiber denier of between 1 and 100.

15. The filter of claim 2 in substantially cylindrical form having a length of about 5 to about 40 mm and a diameter of about 15 to about 30 mm.

16. The filter of claim 2 which is a cigarette filter.

* * * * *

UNITED STATES PATENT AND TRADEMARK OFFICE

CERTIFICATE OF CORRECTION

PATENT NO. : 5,275,859

DATED : January 4, 1994

INVENTOR(S) : Bobby M. Phillips, Steven A. Wilson, Mark A. Pollock

It is certified that error appears in the above-indentified patent and that said Letters Patent is hereby corrected as shown below:

Column 28, line 26, Claim 6 "$2_D4$" should read --- $2\frac{r}{D}$ ---.

Signed and Sealed this

Tenth Day of May, 1994

*Attest:*

*Attesting Officer*

BRUCE LEHMAN

*Commissioner of Patents and Trademarks*